US009556605B2

(12) United States Patent
Elliott

(10) Patent No.: US 9,556,605 B2
(45) Date of Patent: Jan. 31, 2017

(54) UNIVERSAL METHOD OF STRUCTURAL DESIGN AND ASSEMBLY

(71) Applicant: Joseph Elliott, Fontana, CA (US)

(72) Inventor: Joseph Elliott, Fontana, CA (US)

( * ) Notice: Subject to any disclaimer, the term of this patent is extended or adjusted under 35 U.S.C. 154(b) by 0 days.

(21) Appl. No.: 14/847,973

(22) Filed: Sep. 8, 2015

(65) Prior Publication Data

US 2016/0076238 A1 Mar. 17, 2016

Related U.S. Application Data

(63) Continuation-in-part of application No. 14/485,279, filed on Sep. 12, 2014, now abandoned, which is a (Continued)

(51) Int. Cl.
*E04B 1/02* (2006.01)
*E04B 1/61* (2006.01)
(Continued)

(52) U.S. Cl.
CPC . *E04B 1/02* (2013.01); *A47B 3/06* (2013.01); *A47B 47/042* (2013.01); *A47C 4/021* (2013.01); *A47C 4/03* (2013.01); *A63H 3/36* (2013.01); *A63H 3/52* (2013.01); *A63H 33/008* (2013.01); *A63H 33/084* (2013.01); *E04B 1/54* (2013.01); *E04C 2/30* (2013.01); *E04C 2/46* (2013.01); *A47B 2230/0085* (2013.01); *A47B 2230/0092* (2013.01); *Y10T 29/49616* (2015.01)

(58) Field of Classification Search
CPC ..... E04B 1/02; E04B 1/54; A63H 3/53; A63H 3/36; A63H 33/084; A47C 4/03; A47C 4/021; A47B 47/042; A47B 3/06; A47B 2230/0088; A47B 2230/0085; A47B 2230/0092; B23P 11/00; E04C 2/46; E04C 2/30; Y10T 29/49616
See application file for complete search history.

(56) References Cited

U.S. PATENT DOCUMENTS 2,481,671 A 9/1949 John et al.
2,632,498 A 3/1953 Curtis
(Continued)

OTHER PUBLICATIONS

Playskool Outdoor Mickey Mouse Playhouse, Instructions, Published 1989, 4 pages.*

*Primary Examiner* — Jacob Cigna
(74) *Attorney, Agent, or Firm* — Kenneth L. Green; Averill & Green

(57) ABSTRACT

A structural system and method of assembly comprising structural members with slots, and interior structural members. Specific structural members are sequentially interconnected in rigid alignment. A first structural member is positioned with two upward facing slots. Additional structural members are added by engaging downward facing slots of the additional structure members with upward facing slots of the prior structural member. The structural members further include engagement features in cooperating slots. A protruding features engages a recess to retain the engaged structural members. The features may be a partial sphere and a matching recess which may be disassembly, or a tapered protrusion having a squared-off rear edge which resists disassembly, or one of a variety of shapes.

7 Claims, 30 Drawing Sheets

Related U.S. Application Data continuation-in-part of application No. 14/148,451, filed on Jan. 6, 2014, now Pat. No. 8,832,917, which is a continuation-in-part of application No. 13/654,693, filed on Oct. 18, 2012, now Pat. No. 8,621,739, which is a continuation-in-part of application No. 12/587,868, filed on Oct. 13, 2009, now abandoned.

(60) Provisional application No. 61/196,129, filed on Oct. 14, 2008.

(51) Int. Cl.

| | |
|---|---|
| ***E04C 2/30*** | (2006.01) |
| ***E04B 2/00*** | (2006.01) |
| ***A47B 3/06*** | (2006.01) |
| ***A47B 47/04*** | (2006.01) |
| ***A47C 4/02*** | (2006.01) |
| ***A47C 4/03*** | (2006.01) |
| ***A63H 33/08*** | (2006.01) |
| ***A63H 3/36*** | (2006.01) |
| ***A63H 3/52*** | (2006.01) |
| ***A63H 33/00*** | (2006.01) |

(56) References Cited

U.S. PATENT DOCUMENTS

| | | | | |
|---|---|---|---|---|
| 2,832,100 | A | 4/1958 | Swallert | |
| 2,854,724 | A | 10/1958 | Wuorio | |
| 2,915,040 | A | 12/1959 | Ward | |
| 2,918,995 | A | 12/1959 | Kruger | |
| 3,066,436 | A | 12/1962 | Schuh | |
| 3,069,216 | A | 12/1962 | Vaeth | |
| 3,143,236 | A | 8/1964 | Haas | |
| 3,195,507 | A | 7/1965 | Miller | |
| 3,300,245 | A | 1/1967 | Rumble | |
| 3,807,116 | A | 4/1974 | Flynn | |
| 3,879,906 | A | 4/1975 | Hollenbert | |
| 4,011,706 | A | 3/1977 | Dupree | |
| 4,019,298 | A | 4/1977 | Johnson, IV | |
| 4,082,356 | A | 4/1978 | Johnson | |
| 4,267,998 | A | 5/1981 | Weirich | |
| 4,523,418 | A | 6/1985 | McLaughlin | |
| 4,582,002 | A | 4/1986 | Wright | |
| 5,076,546 | A | 12/1991 | Henry | |
| 5,076,549 | A | 12/1991 | Hashiguchi et al. | |
| 5,518,171 | A | 5/1996 | Moss | |
| 5,527,103 | A | 6/1996 | Pittman | |
| 5,580,294 | A | 12/1996 | Briant | |
| 5,797,236 | A | 8/1998 | Posey et al. | |
| 5,865,660 | A | 2/1999 | Smith | |
| 6,174,116 | B1 | 1/2001 | Brand | |
| 6,267,065 | B1 | 7/2001 | Lin | |
| 6,312,305 | B1 * | 11/2001 | McCormick | A63H 33/084 446/106 |
| 6,412,245 | B1 | 7/2002 | Lane et al. | |
| 6,532,878 | B2 | 3/2003 | Tidemann | |
| 6,595,378 | B2 | 7/2003 | Wang | |
| 7,108,577 | B2 | 9/2006 | Peters et al. | |
| 7,654,055 | B2 | 2/2010 | Ricker | |
| 8,079,315 | B2 | 12/2011 | Berent et al. | |
| 8,458,980 | B2 | 6/2013 | Ivanov | |
| 2003/0205180 | A1 | 11/2003 | Bishop | |
| 2008/0231089 | A1 | 9/2008 | LaPointe et al. | |
| 2010/0093257 | A1 | 4/2010 | Elliott | |

* cited by examiner

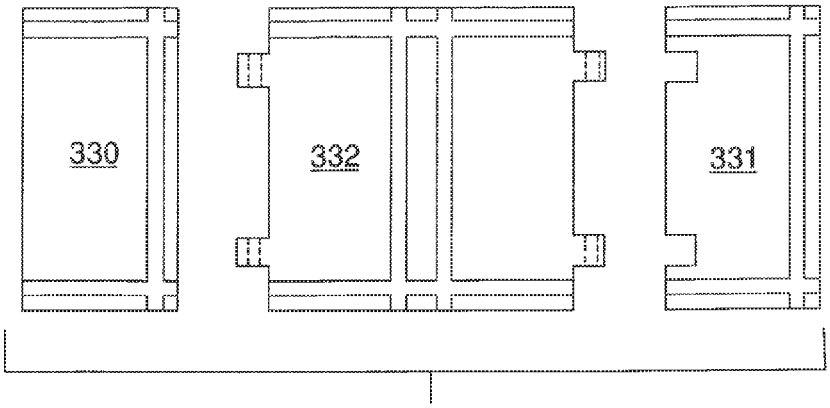
Fig. 61
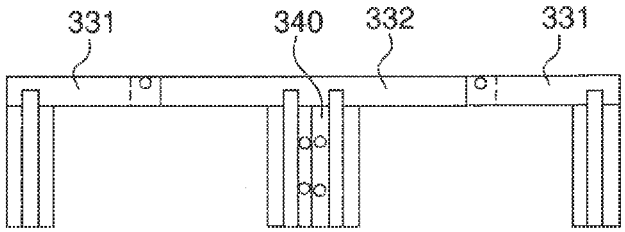
Fig. 62
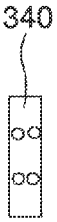
Fig. 62A
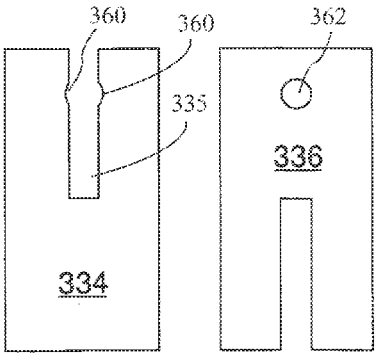
Fig. 63A
Fig. 63B
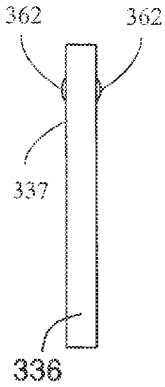
Fig. 63C
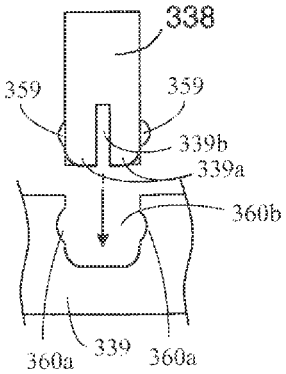
Fig. 63D

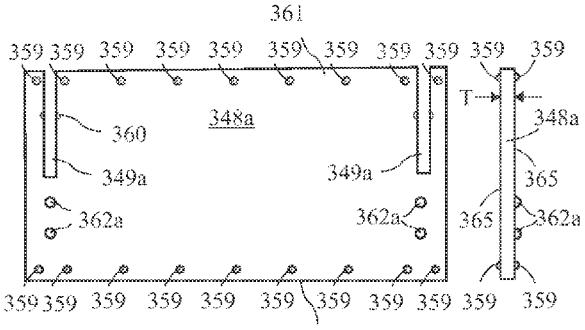
FIG. 88A FIG. 88B
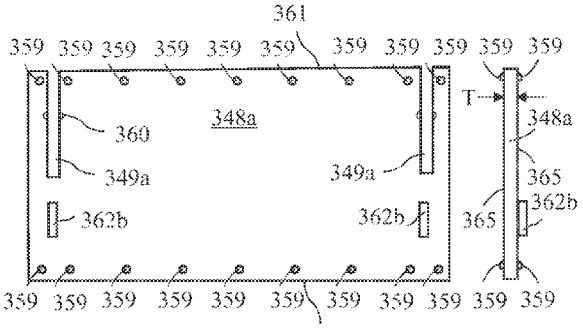
FIG. 89A FIG. 89B
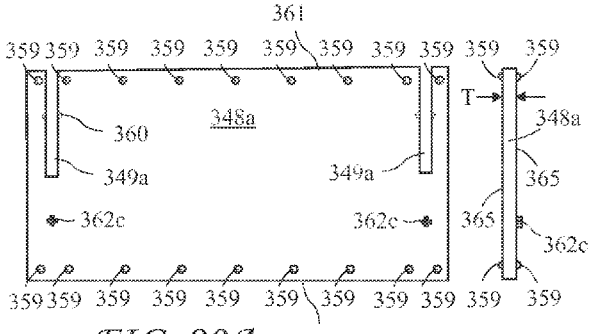
FIG. 90A FIG. 90B
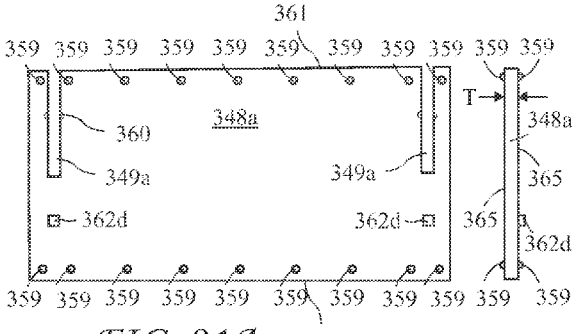
FIG. 91A FIG. 91B
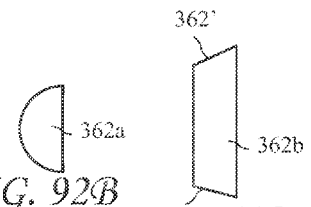
FIG. 93C
FIG. 92B FIG. 93B
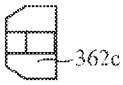
FIG. 94B
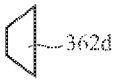
FIG. 95B
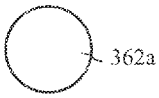
FIG. 92A
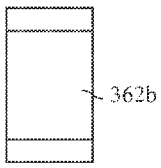
FIG. 93A
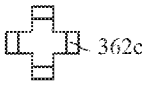
FIG. 94A
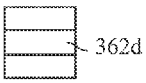
FIG. 95A

UNIVERSAL METHOD OF STRUCTURAL DESIGN AND ASSEMBLY

CROSS-REFERENCE TO RELATED APPLICATIONS

The present application claims the benefit of U.S. Provisional Application No. 61/196,129 filed Oct. 14, 2008, and is a Continuation In Part of U.S. patent application Ser. No. 12/587,868 filed Oct. 13, 2009, and is a Continuation In Part of U.S. patent application Ser. No. 13/654,693 filed Oct. 18, 2012, and is a Continuation In Part of U.S. patent application Ser. No. 14/148,451 filed Jan. 1, 2014, and is a Continuation In Part of U.S. patent application Ser. No. 14/485,279 filed Sep. 12, 2014, which applications are incorporated in their entirety herein by reference.

BACKGROUND OF THE INVENTION

The present invention relates to the assembly of structures using modular components. More particularly, the invention concerns a method allowing the assembly of structures and objects using planar, interlocking components, by a single individual.

Known construction methods require two or more workers to lift, hold, and attach structural members. When enough workers are not present, either the work cannot continue, or only continue with risk of an accident.

Known methods of assembling structural sections include protrusions to retain assembled sections. Some known protrusions have to be soaked in liquid so that they can be forced into a cavity and then they dry out and expand to the shape of the cavity and they are glued in place. Others are barbed expandable protrusions that attach aluminum siding to wood. The pieces in these two examples cannot be disassembled and assembled again.

BRIEF SUMMARY OF THE INVENTION

The present invention addresses the above and other needs by providing a means of obtaining low cost, quality houses which offer a great deal more protection from tornadoes and earthquakes than traditional stick built houses. Complete floor, wall and roof pieces can be unloaded in sequential order from a trailer at the construction site by a crane and quickly assembled in the same sequential order. The overlapping wall pieces support each other and thereby resist movement in all horizontal directions and the sequential order of connecting pieces makes assembly easy and fast.

In accordance with one aspect of the invention, there is provided a method and structure for constructing structures with various shapes. For example, triangular, pentagonal, hexagonal, octagon structures, and irregular shaped structures can be constructed. Rooms may thus have as many sides or shapes as desired including meandering shapes and sequentially constructed rooms circling to enclose a center courtyard.

In accordance with another aspect of the invention, there is provided a method and structure for adding partitions after assembling a room or an entire perimeter of a structure. The partition including two down facing slots engaged into two up facing slots on opposite sides to divide a room or an entire perimeter of a structure into two rooms. The partition may be across the middle of the room, or an entire perimeter of a structure, to form two equal sized rooms. Further, a second partition having three down facing slots can engage the first partition and two walls having three upward facing slots. One of the upward facing slots is located in the center of the first partition and the other two upward facing slots are located on walls on opposite sides of the room, the first and second partition dividing the original room into four rooms which could be of the same size or different size rooms depending on the positions of the first partition and the second partition. The partitioning method can be applied to several rooms in the same structure. The method of adding partitions can continue to design a house or module as desired. The partition method applied to dividing the interior of a perimeter into smaller rooms may require longer structural panels than those used in the normal sequential order of assembly as shown in this invention, but would allow the use of fewer pieces. A two room structure can be assembled with five pieces using the partition method and would require seven pieces without partitions. An eight room house can be assembled using eight wall pieces with the partition method of assembly and would require 22 wall pieces without using the partitions.

In accordance with still another aspect of the invention, there is provided a method and structure for assembling a room or module can have as many sides or structural members as desired and these sides or structural members can be interlocked to each other in such a way that they produce patterns of design that zigzag, meander or produce any normal geometrical design and the structural members can be made of any construction material and also any combination of materials such as used in a honeycomb panel or wall. Other light weight panels or walls are formed from a strong honey comb metal shell shaped like the panels or walls of the present invention, which are filled with cement, water, oil, or sand after a structure is assembled. All of the structures can either be assembled by an individual or the assembly of the structure can be supervised by an individual due to the repetitive sequential order of assembly.

In accordance with another aspect of the invention, there are provided embodiments of the present invention allowing for the construction of real or toy chairs, tables, bookshelves, chests, houses, and other structures with internal storage capacity or the ability to support a person or objects. Particular embodiments can be vertically stacked or laterally joined to form extended structures.

In accordance with one aspect of the invention, there are provided design methods and construction techniques using sheets or slabs of any construction material, man-made or natural, to manufacture and assemble many objects and structures. The structural members may be solid or hollow with interlocking legs inserted into slots located in bases of various geometrical forms. The solid or hollow support members are interchangeable and many bases are also interchangeable. This produces modules which can be stacked vertically and expanded horizontally. All pieces of the modules can have decorative cuts forming their shape as well as decorative cuts and designs on their surfaces producing a large number of objects and structures. These include, for example, a toe protector, furniture, toy furniture, dollhouses, playhouses, walls, floors, ceiling and the roof of a structure.

In accordance with another aspect of the invention, there are provided one or more advantages over known methods for assembling structures, furniture, and toys. The present invention provides methods for easy design, manufacture, assemble and disassemble of objects and structures, and allows more variations and sets of furniture, and provides methods for children to assemble their own toy furniture, doll houses, playhouses, toys, and construction games.

In accordance with still another aspect of the invention, the present invention provides improved stability or rigidity. The stability or rigidity of a structure or object of a structure assembled according to the present invention is established by the manufacturer based on parameters which include the precision of cuts for the slots, the type of material being used, the size of the individual pieces, the weight of the pieces, provided by the manufacturer based on the particular application of the structure.

In accordance with another aspect of the invention, there are provided objects, when made in accordance with the present invention, which may not require extra rigidity. These objects may include most tables made of heavy pieces of granite, marble or wood, a toe protector, most children's objects or structures, some structures in some places due to overlying weight or needing flexibility in case of earthquakes, and most objects made of foam.

In accordance with yet another aspect of the invention, there is provided a method and structure which allows children to assemble and disassemble very fast many toy structures, houses, buildings and furniture. Children can assemble and inhabit large playhouses. Each type of structure and the use of it needs a particular type of rigidity and different degrees of rigidity and the same circumstances exist for retainability. Different methods are described needed for proper rigidity and retain ability after explaining the many design capabilities and uses of my invention.

In accordance with one aspect of the invention, there are provided tables and chairs assembled using fasteners accordance with the present invention. The fastener of choice in such cases is a thumb screw which is ¼ or one turn, and which is readily available at, for example, local hardware stores or Internet fastener supply sources. Preferred locations for fasteners and methods of holding children's toys together with fasteners are described.

In accordance with still another aspect of the invention, there is provided a ready to assemble toe protector. The toe protector is placed at the foot end of a bed for supporting bed covers above a person's toes. This is important for people with arthritis or injury. It is also useful for a person who paints their toe nails at night and would have to wait an hour for them to dry before retiring; or purchase a heater which cost a lot more than the toe protector. The toe protector can be made from inexpensive stiff foam. It can be assembled and disassembled in less than a minute. Another use of the module is as a desk or as a bookcase, providing that shelves are added to the module. Each module stacked vertically may serve as another shelf in the bookcase. Further, drawers can be added to form a chest of drawers or a desk with drawers.

In accordance with another aspect of the invention, there are provided a storage or toy chest, any kind of table, a footstool, a low work chair, a bench, as a module in a structure, a storage shed, a wall and a floor. The module can also be used as a playhouse for children by increasing the physical dimensions of all pieces and removing the bottom base and providing cutouts for doors and windows to produce a large outdoor playhouse. A hallway can be assembled to connect two rooms of a playhouse by using two structural members inserted into up facing slots of the walls of each room with doorways between the slots. The playhouse can be constructed from thick, soft foam pieces for small children who would enjoy falling into the walls and seeing the house move. Stiff foam and other materials can also be used for older children. They can build their own playhouses and furniture and toys using the simple repeatable assembly techniques illustrated and explained in this disclosure. A large number of toys can be designed and manufactured, especially with the use of injection molding. The outside surfaces of the support members and bases can have the shape of a train locomotive and cars, trucks, etc. The bottom base could have means for attaching wheels. Construction game puzzles are yet another use of this method of design and construction techniques.

In accordance with yet another aspect of the invention, there are provided module bases which can be of any geometrical shape such as, round, rectangular, square, octahedron and triangle shaped. Also, the module bases can have groove patterns of many geometrical shapes.

In accordance with another aspect of the invention, there are provided chairs of various sizes and constructions. A loveseat, settee or bed can also be provided by changing the physical dimensions of the parts of the chairs.

In accordance with still another aspect of the invention, there are provided a dollhouse, playhouse or two story structure of any type for children. The system of the invention can be used to produce very long structures such as seen in European towns. Using the structural members, a model village could be assembled by children. A mobile home could be constructed using some of the methods of this invention which could be assembled on a site mostly by unskilled labor and then disassembled if one wished to move the structure.

In accordance with still another aspect of the invention, there is provided a method for sequentially interconnecting the structural members in rigid alignment. The method includes the steps of positioning a first structural member having vertically side by side first and second parallel slots with the first and second parallel slots facing upward, lifting a second structural member having vertically offset third and fourth parallel slots above the first structural member with the third slot facing downward, lowering the second structural member and engaging the third slot of the second structural member with the second slot of the first structural member providing a stable structure, lifting a third structural member having vertically offset fifth and sixth parallel slots above the second structural member with the fifth slot facing downward, lowering the third structural member and engaging the fifth slot of the third structural member with the fourth slot of the second structural member providing a more stable structure, lifting a fourth structural member having vertically side by side seventh and eighth parallel slots above the third structural member with the seventh and eighth slots facing downward, lowering the fourth structural member and at the same time, engaging the seventh slot of the fourth structural member with the sixth slot of the third structural member and engaging the eighth slot of the fourth structural member with the first slot of the first structural member providing a completed stable structure.

In accordance with another aspect of the invention, there is provided a method of construction to obtain low cost quality houses which offers maximum possible protection from earthquakes and high winds. Wall pieces with 45 degree slots at each end provide support to each other in two horizontal directions when placed in the grooves of the floor and roof pieces and such wall pieces can be used as the perimeter of a house or other structure.

In accordance with still another aspect of the invention, there is provided a method of construction including a groove or cutout located in the top surface of a floor piece or/and the bottom surface of a roof piece. The top and bottom edges of wall sections may be inserted into their respective grooves and the pieces will be interlocked and provide a certain amount of retainability and rigidity dependent on many variables. Rigidity is mainly a function of how close the width of the wall section matches the width of the groove in the floor or ceiling piece. Rigidity also depends on the type and weight of the material of the pieces. Large pieces of stone are stand-alone items and possess the rigidity and retain ability needed to assemble a table or a house or a work of art. A toy table assembled by a child made of plastic, metal or wood present variables of elasticity of the different materials and the strength of the child doing the assembly and disassembly and the use of the table as to whether it is a small table or one large enough to use as a real table. The depth and width of grooves may be fractions of an inch or several inches. Legs can be any thickness and occupy the entire length of groove or any portion thereof. Legs could be in the shape of a partial cylinder which would match the cutout. Protrusion may be a partial cylinder or a partial sphere or any shape as discussed below in the following paragraph. The height of the protrusions above the surface of the legs can be adjusted and the top edge of a piece can have an adjustable ramp that matches a ramp on the outside edges of legs which will allow easy connection of the pieces.

In accordance with yet another aspect of the invention, there is provided a method of construction of toy structures marked with sequential numbers or letters on their pieces to produce teaching aides. The repetitive sequential order of structural assembly will teach children the alphabet and how to count while being creative in the assembly of many structures. These structures may be made using a stiff thick paper to provide an economical class room teaching aide. All unmarked teaching aides become a puzzle which could be used for entertainment and learning pattern recognition. Playhouses of all sizes, teaching aides and puzzles for young children can be assembled without a floor. The floor adds complication to the assembly process and is not necessary. The assembly and disassembly of these structures is fast and easy and provides enough rigidity so that the structure holds its shape.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 61 is a bottom view of three further bases each adapted to be combined with other base portions to form a structure in accordance with the present invention;

FIG. 62 is a front view of a further structure in accordance with the present invention which involves the interconnection of three bases, and a bracket securing adjacent support members together;

FIG. 62A shows a bracket providing additional structural rigidity;

FIG. 63A depicts a plan view of a panel having recesses in a slot adapted to improve the rigidity of a structure assembled in accordance with the present invention;

FIG. 63B depicts a plan view of a cooperating panel having protrusions on a surface adapted to improve the rigidity of a structure assembled in accordance with the present invention;

FIG. 63C depicts an edge view of the cooperating panel having the protrusions on the surface adapted to improve the rigidity of a structure assembled in accordance with the present invention;

FIG. 63D depicts a top or bottom edge of a panel having protrusions cooperating with a horizontal groove in a floor having recesses in accordance with the present invention;

FIG. 88A shows a front view of a wall panel having rounded panel attaching protrusions and floor and roof attaching protrusions.

FIG. 88B shows an edge view of a wall panel having rounded panel attaching protrusions and floor and roof attaching protrusions.

FIG. 89A shows a front view of a wall panel having extended rounded panel attaching protrusions and floor and roof attaching protrusions.

FIG. 89B shows an edge view of a wall panel having extended rounded panel attaching protrusions and floor and roof attaching protrusions.

FIG. 90A shows a front view of a wall panel having cruciform panel attaching protrusions and floor and roof attaching protrusions.

FIG. 90B shows an edge view of a wall panel having cruciform panel attaching protrusions and floor and roof attaching protrusions.

FIG. 91A shows a front view of a wall panel having a square with two opposing edges tapered attaching protrusions and floor and roof attaching protrusions.

FIG. 91B shows an edge view of a wall panel having the square with two opposing edges tapered panel attaching protrusions and floor and roof attaching protrusions.

FIG. 92A shows a front view of the panel attaching protrusion feature comprising a simple rounded bump.

FIG. 92B shows a side view of the panel attaching protrusion feature comprising a simple rounded bump.

FIG. 93A shows a front view of the panel attaching protrusion feature comprising an extended rounded bump.

FIG. 93B shows a side view of the panel attaching protrusion feature comprising an extended rounded bump.

FIG. 93C shows a top view of the panel attaching protrusion feature comprising an extended rounded bump.

FIG. 94A shows a front view of the panel attaching protrusion feature comprising a cruciform shape.

FIG. 94B shows a side view of the panel attaching protrusion feature comprising a cruciform.

FIG. 95A shows a front view of the panel attaching protrusion feature comprising a square with two opposing edges tapered.

FIG. 95B shows a side view of the panel attaching protrusion feature comprising a square with two opposing edges tapered.

FIG. 96 shows a top view of a two section floor according to the present invention.

FIG. 97 show a cross-sectional view of the two section floor according to the present invention taken along line 97-97 of FIG. 98.

FIG. 98A shows a top view of a two piece floor and wall sections according to the present invention;

FIG. 98B shows a front view of the two piece floor and wall sections according to the present invention;

FIG. 99A shows a top view of a four piece floor for a rear of a structure according to the present invention;

FIG. 99B shows a top view of a four piece floor for the front of a structure according to the present invention;

FIG. 100 shows a bolt used to attach floor sections according to the present invention;

Figure 101B:
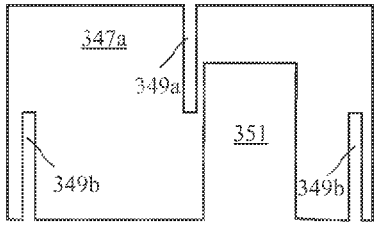
Figure 101A:
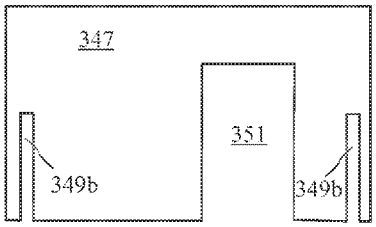
Figure 101C:
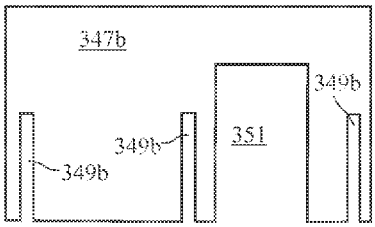
Figure 102A:
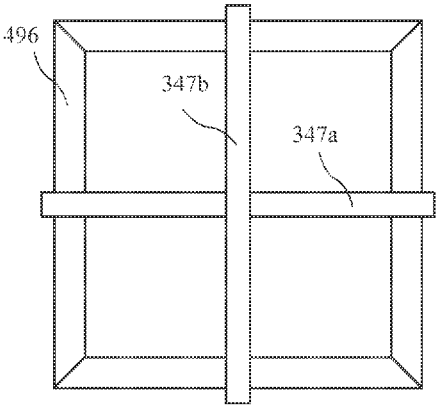
Figure 102B:
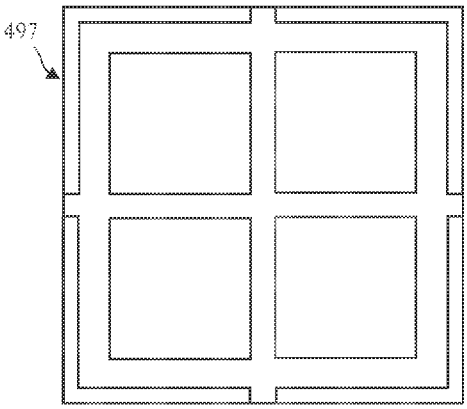

FIG. 101A a single room partition according to the present invention;

FIG. 101B shows a second room partition for dividing as room into four rooms according to the present invention;

FIG. 101C shows a cooperating second room partition for dividing as room into four rooms according to the present invention;

FIG. 102A shows a perimeter structure divided into four rooms according to the present invention;

FIG. 102B shows a floor or roof for the structure of FIG. 102A

Figure 103A:
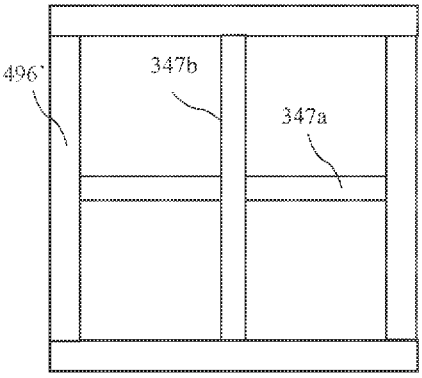
Figure 103B:
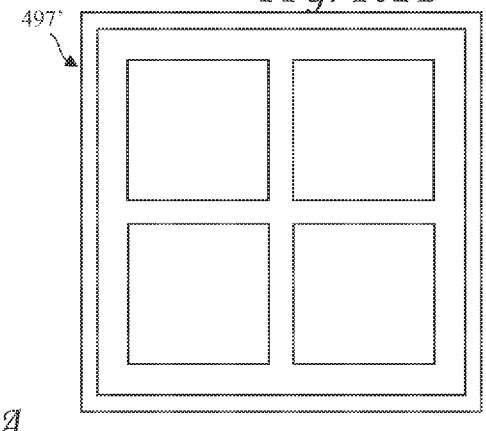
Figure 104:
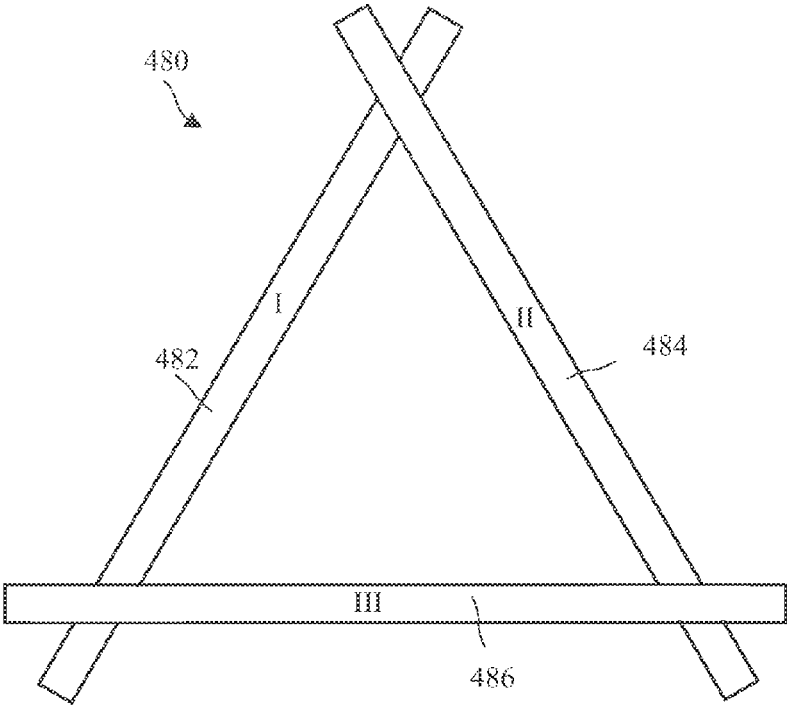
Figure 105:
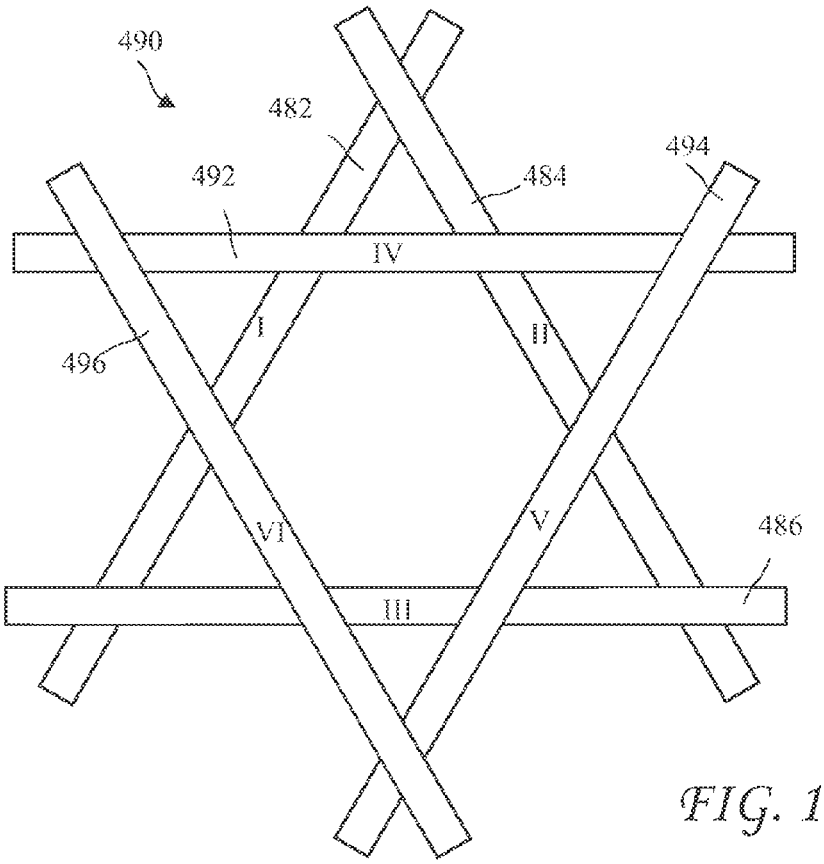

FIG. 103A shows a second perimeter structure divided into four rooms according to the present invention;

FIG. 103B shows a floor or roof for the structure of FIG. 103A;

FIG. 104 shows a triangular structure or puzzle according to the present invention;

FIG. 105 shows a six sided structure or puzzle according to the present invention.

Figure 106:
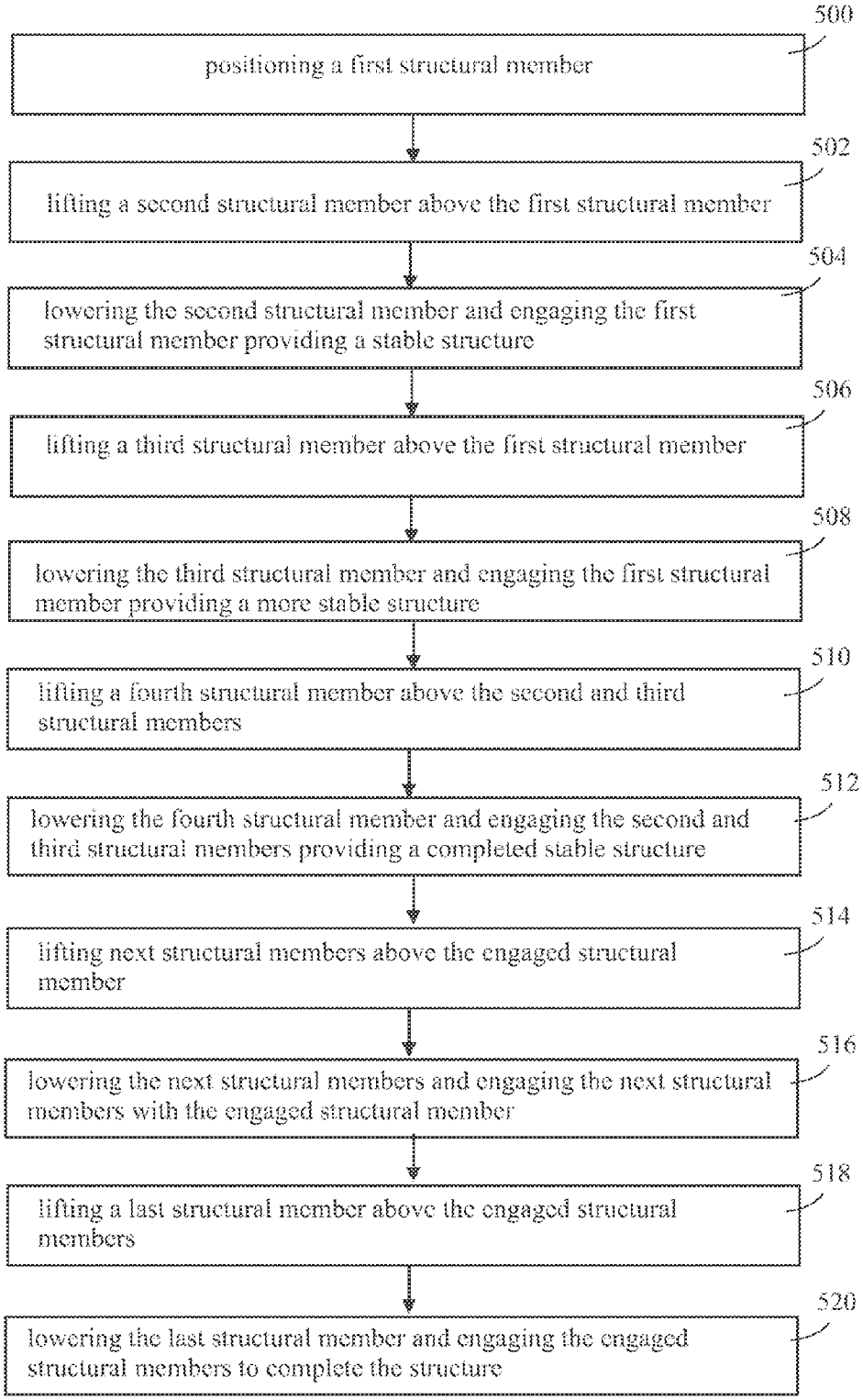
Figure 107:
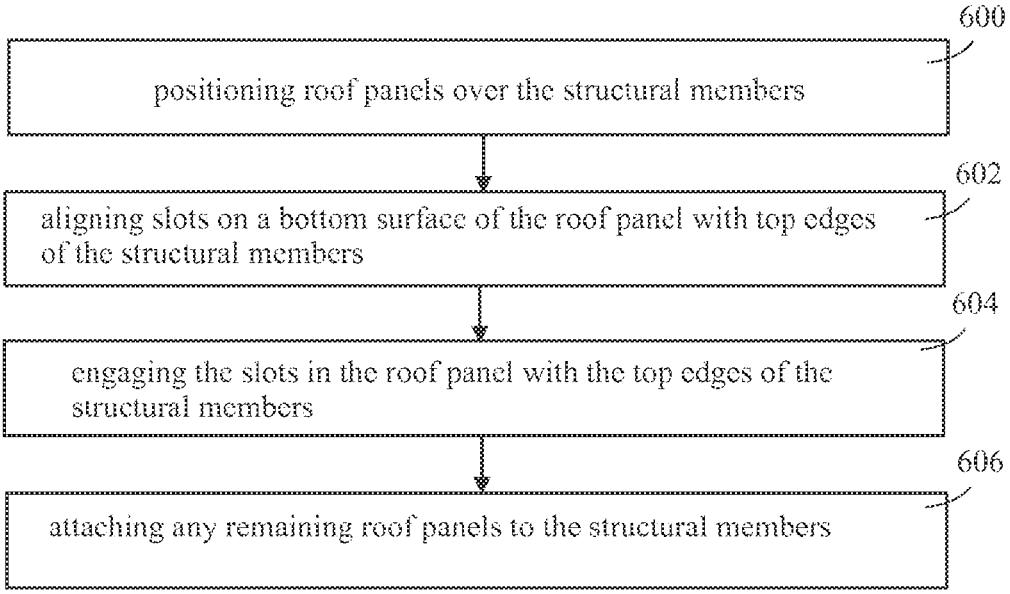
Figure 108:
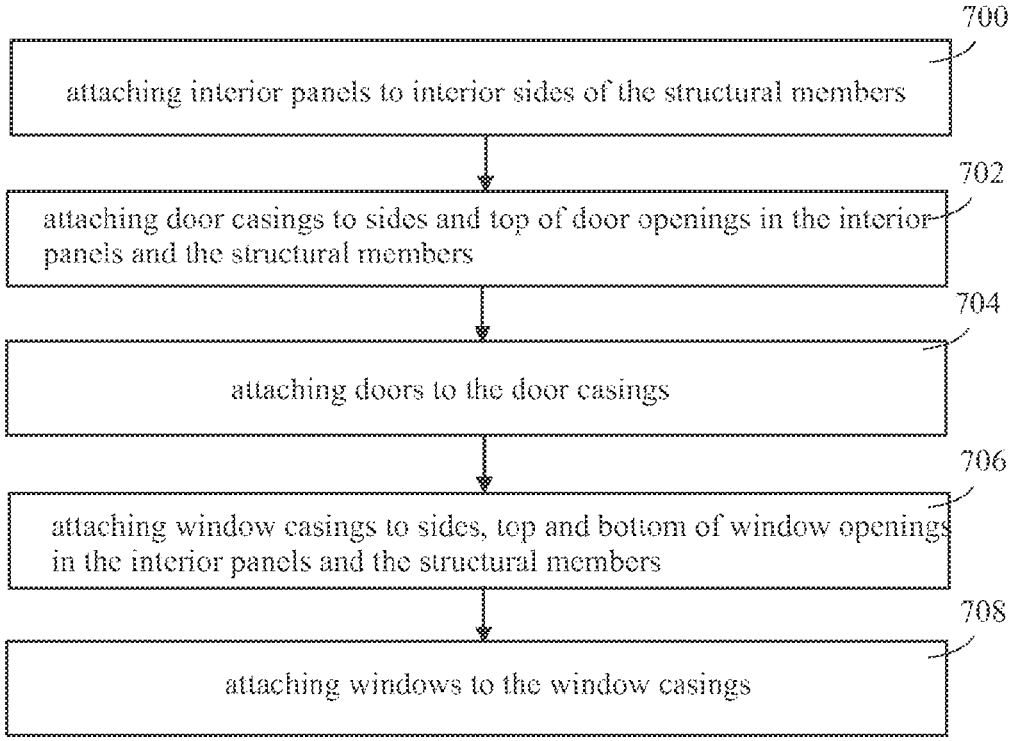

FIG. 106 shows a method for assembling structural members according to the present invention;

FIG. 107 shows a method for attaching a roof panel to an assembled structure according to the present invention;

FIG. 108 shows a method for adding interior panels and doors and windows to an assembled structure according to the present invention;

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

DEFINITIONS

As used herein the following terms mean:

Table: An article of furniture supported by one or more vertical legs and having a flat horizontal surface.

Chair: A piece of furniture consisting of a seat, legs, back, and often arms, designed to accommodate one person.

Desk: A piece of furniture usually with a flat top for writing and drawers or compartments.

Chest: A small closet or cabinet with shelves for storing supplies.

Stool: A backless and armless single seat supported on legs or a pedestal; a low bench or support for the feet or knees in sitting or kneeling, as a footrest.

Figure 24:
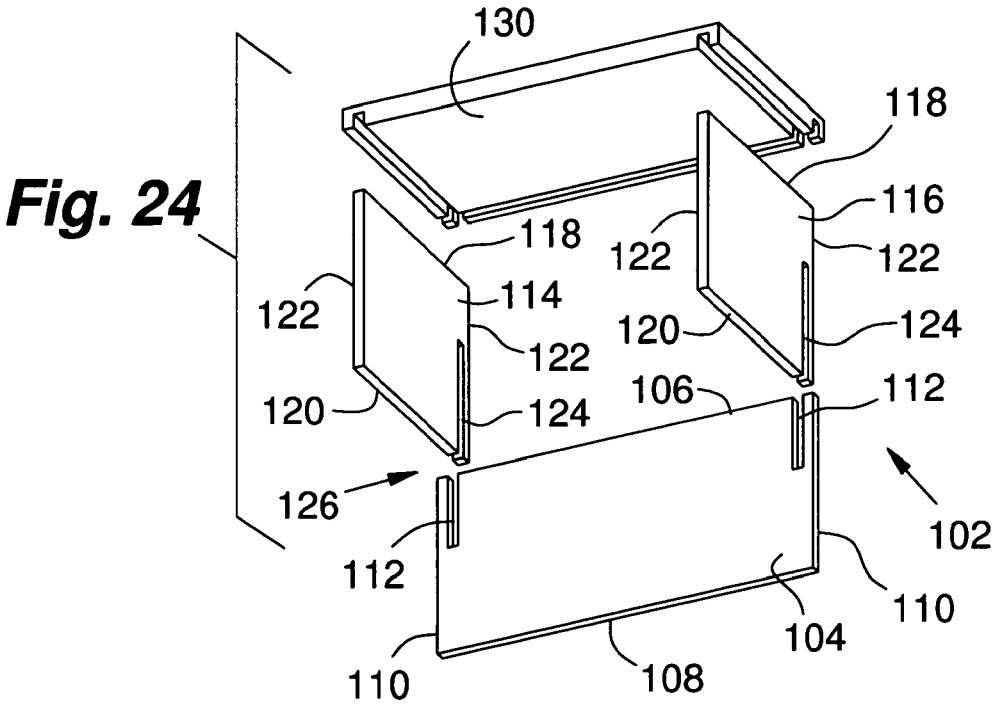
FIG. 24 is an exploded perspective view of a toe protector structure in accordance with the present invention.
Figure 25:
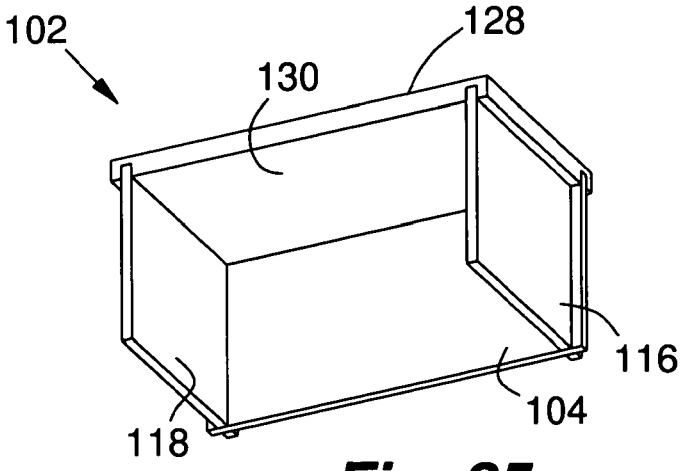
FIG. 25 is a perspective view of the tow protector of FIG. 24, in assembled form.

Referring to the drawings and particularly to FIGS. 1, 3, 7, 8, 24 and 25 one form of the structural furniture system of the present invention is there shown and generally designated in FIGS. 24 and 25 by the numeral 102. This form of the invention and its assembled form can be used for various purposes including a toe protector that can be placed with the front side open at the foot of the bed for supporting bedcovers above a person's toes. This is important for people with arthritis or injury. It is also useful for people who paint their toenails at night and without this device would have to wait a substantial length of time for them to dry before retiring. The toe protector can be made from various materials such as wood, foam and various composites and can be assembled and disassembled in a very short period of time. Another use for this form of the invention is as a desk or as a bookcase.

Figure 7:
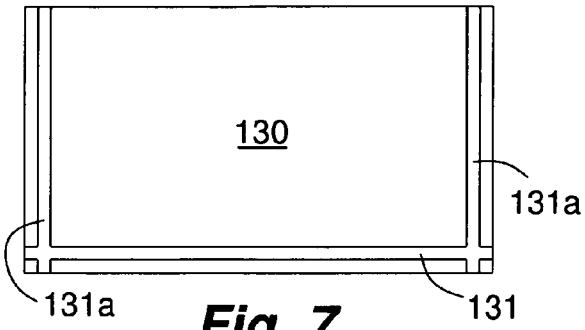
FIG. 7 is a bottom view of a base in accordance with the present invention including two laterally opposed grooves intersecting one longitudinal groove.
Figure 8:
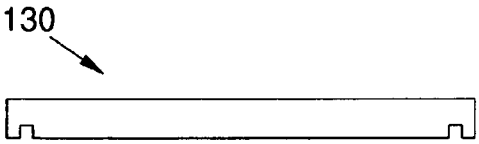
FIG. 8 is a front view of the base of FIG. 7.

In the present form of the invention, the structure identified by the numeral 102 comprises a first generally planar, substantially rectangular member 104 having an upper edge 106, a lower edge 108, spaced apart lateral edges 110 and first slots 112 formed proximate each of the lateral edges 110. Second and third generally planar rectangular members 114 and 116 respectively, which are adapted to be connected to first member 104, have an upper edge 118, a lower edge 120, spaced apart lateral edges 122 and second connector slots 124 formed proximate each of the lateral edges 122. As indicated in FIGS. 24 and 25, second connector slots 124 are uniquely constructed and arranged to mateably engage the first connector slots 112 of first member 104 to join together the first, second and third members to form a first precursor structure 126. Connected to the upper edges 118 and lower edges 120 of the second and third members 114 and 116 to form structure 102 is a generally planar, substantially rectangular top, or fourth member 130. As best seen in FIGS. 7 and 8 of the drawings, member 130 is provided with a plurality of grooves 131 with grooves 131*a* being constructed and arranged to mateably engage the upper edges of second and third members 114 and 116.

Figure 10:
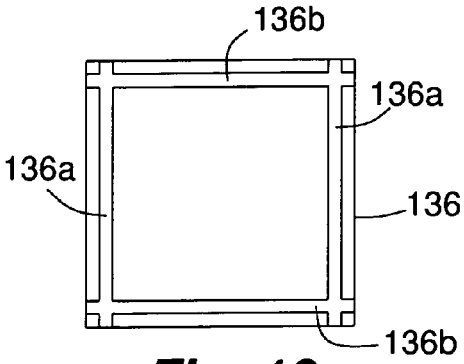
FIG. 10 is a bottom view of another base in accordance with the present invention having two laterally opposed grooves intersecting two longitudinally opposed grooves.
Figure 11:
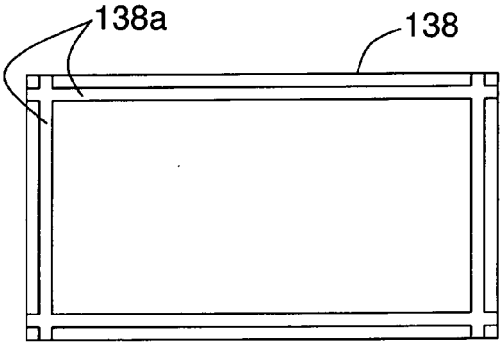
FIG. 11 is a bottom view of a base similar to, but more elongated than the base of FIG. 10.
Figure 9:
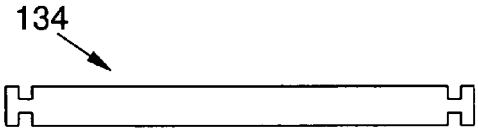
FIG. 9 is a front view of a further base in accordance with the present invention having a similar groove pattern as shown in FIG. 7, but on both the top and bottom faces of the base.
Figure 12:
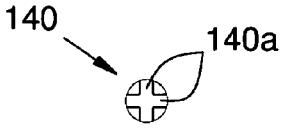
FIG. 12 is a top view of another base in accordance with the present invention having two centrally intersecting grooves, the ends of each groove being exposed laterally.
Figure 14:
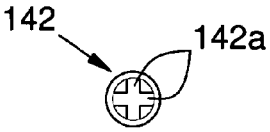
FIG. 14 is a top view of another base in accordance with the present invention having two centrally intersecting grooves, each groove terminating within the base perimeter edge.
Figure 16:
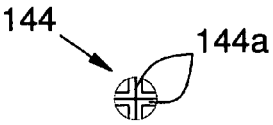
FIG. 16 is a top view of another base in accordance with the present invention similar in configuration to that of FIG. 12, but wherein the centrally intersecting grooves are V shaped to aid in alignment during assembly.
Figure 13:
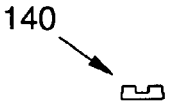
FIG. 13 is a side view of the base shown in FIG. 12.
Figure 15:
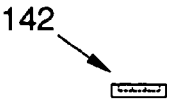
FIG. 15 is a side view of the base shown in FIG. 14.
Figure 17:
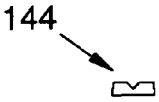
FIG. 17 is a side view of the base shown in FIG. 16.

FIGS. 9 through 17 of the drawings illustrate various alternate forms of top and bottom members of the invention. More particularly, FIG. 9 is a front view of an alternate top member 134 having a similar groove pattern to the top member shown in FIG. 7, but having grooves provided on both the top and bottom faces of the member. Similarly, FIG. 10 is a bottom view of still another top member 136 having two laterally opposed grooves 136*a* intersecting two longitudinally opposed grooves 136*b*. In FIG. 11 there is depicted in bottom view yet another top member 138 that is similar to, but more elongated than top member 130. FIG. 12 is a top view of a bottom member 140 having two centrally intersecting grooves 140*a*, the ends of each groove being exposed laterally. FIG. 13 is a side view of the bottom member shown in FIG. 12. FIG. 14 is a top view of yet another bottom member 142 having two centrally intersecting grooves 142*a*, each groove terminating within the perimeter of the top member. FIG. 15 is a side view of the bottom member 142. FIG. 16 is a top view of another bottom member 144 that is somewhat similar in configuration to that of FIG. 12, but wherein the centrally intersecting grooves 144*a* are "V" shaped to aid in alignment during assembly. FIG. 17 is a side view of the bottom member 144.

Figure 26:
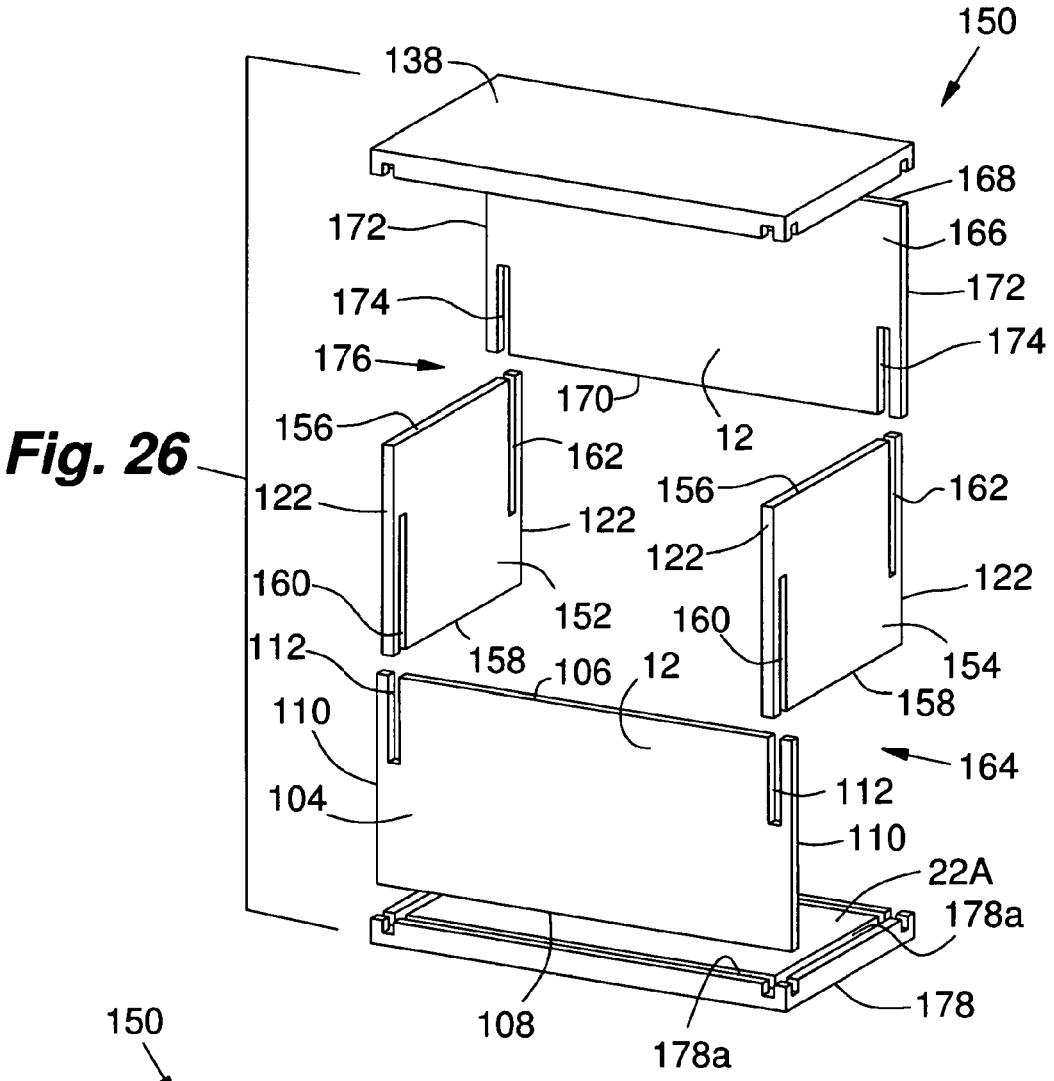
FIG. 26 is an exploded perspective view of a further structure in accordance with the present invention, which is particularly suitable as a coffee table or other enclosed object.
Figure 27:
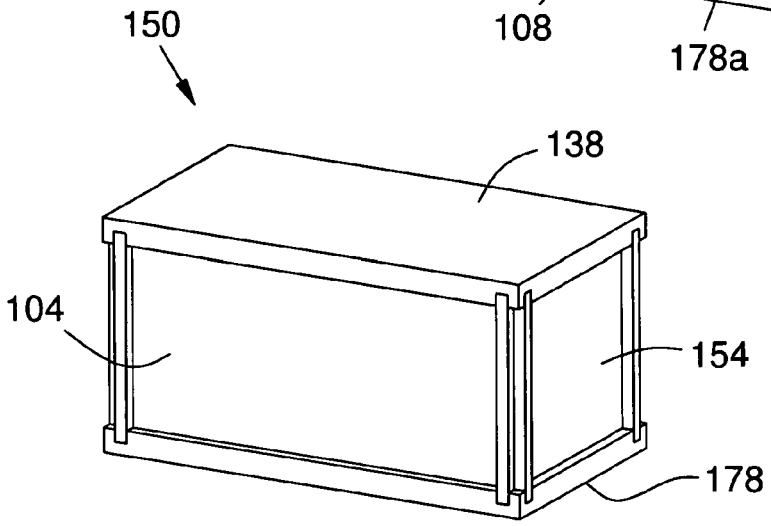
FIG. 27 is a perspective view of the structure of FIG. 26, in assembled form.

Turning now to FIGS. 26 and 27, an alternate form of the structural furniture system of the present invention is there shown and generally designated by the numeral 150. This form of the invention is similar in many respects to the system illustrated in FIGS. 24 and 25 and like numerals are used in FIGS. 26 and 27 to identify like components. In its assembled form, furniture system 150 can be used for various purposes including a storage chest, a toy chest, a table, a low work chair, a bench and the like.

Figure 2:
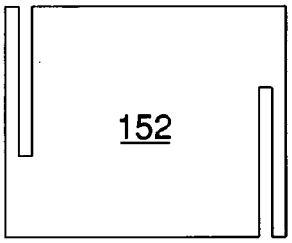
FIG. 2 is a plan view of a further support member in accordance with the present invention including a down facing slot and an up facing slot.

Furniture system 150 here comprises a first generally planar, substantially rectangular member 104 having an upper edge 106, a lower edge 108, spaced apart lateral edges 110 and first slots 112, formed proximate each of the lateral edges 110. Second and third generally planar rectangular members 152 and 154 respectively, which are adapted to be connected to first member 104, have an upper edge 156, a lower edge 158, spaced apart lateral edges 122 and first and second connector slots 160 and 162 formed proximate each of the lateral edges 122 (see also FIG. 2). As indicated in FIGS. 24 and 25, first connector slots 160 are uniquely constructed and arranged to mateably engage the first connector slots 112 of first member 104 to join together the first, second and third members to form a first precursor structure 164. In a manner presently to be described, a fourth, or top member is interconnected with the first precursor structure 164. A generally planar, substantially rectangular fifth, or back member 166 is also adapted to be interconnected with first and second members 152 and 154 in a manner illustrated in FIGS. 26 and 27 of the drawings. Member 166 has an upper edge 168, a lower edge 170, spaced apart lateral edges 172 and downwardly extending slots 174 formed proximate each of the lateral edges 172. As indicated in FIGS. 26 and 27, downwardly extending connector slots 174 are uniquely constructed and arranged to mateably engage the second connector slots 162 of members 152 and 154 to join together member 166 with members 152 and 154 to form a precursor structure 176.

As previously mentioned, a generally planar, substantially rectangular fourth, or top member, such as the top member 138 illustrated in FIG. 11, is connected to the upper edges of members 104, 152, 154 and 166 to form a table, or workbench-like structure. Member 138 is provided with a plurality of grooves 138*a* that are constructed and arranged to mateably engage the upper edges of members 104, 152, 154 and 166.

Connected to the lower edges of members 104, 152, 154 and 166 to form chest structure 150 is a generally planar, substantially rectangular bottom member 178, which is similar to the member 138 illustrated in FIG. 11. Bottom member 178 is provided with a plurality of grooves 178*a* that are constructed and arranged to mateably engage the lower edges of members 104, 152, 154 and 166.

Figure 28:
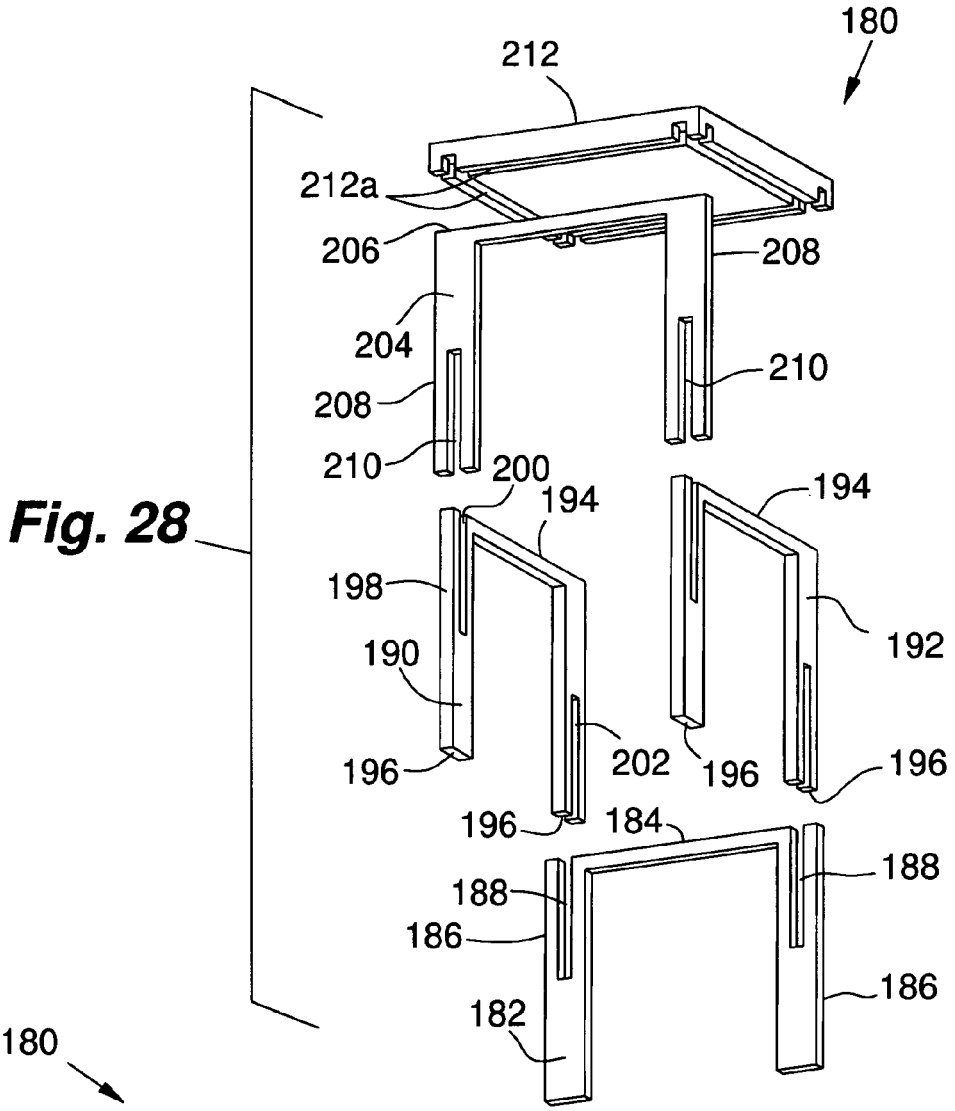
FIG. 28 is an exploded perspective view of a table structure in accordance with the present invention, where the ends of each groove in the base are laterally exposed at the periphery of the base.
Figure 29:
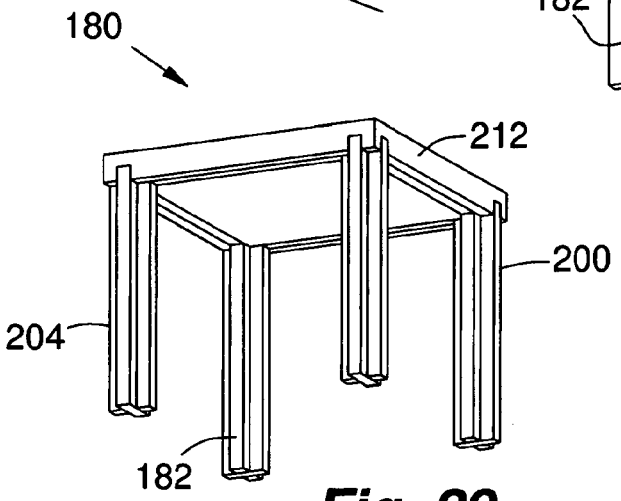
FIG. 29 is a perspective view of the structure of FIG. 28, in assembled form.
Figure 30:
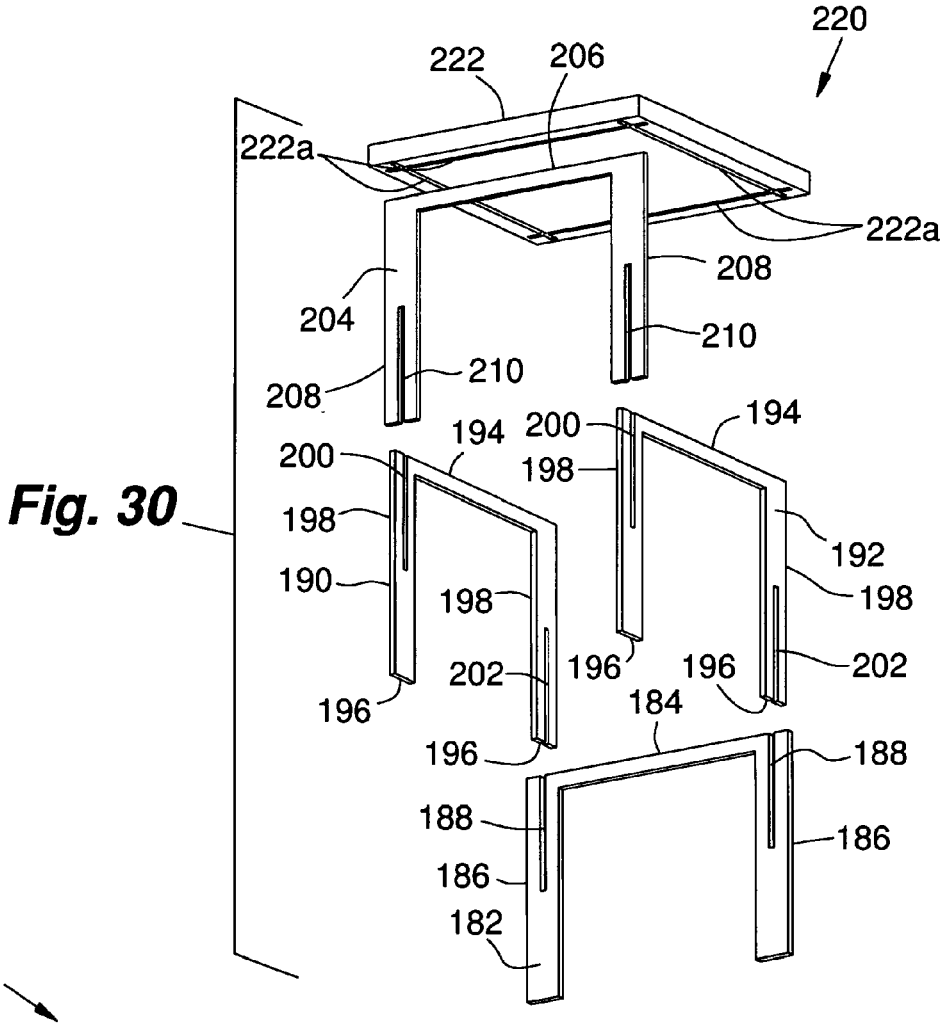
FIG. 30 is an exploded perspective view of a further table structure in accordance with the present invention, where each groove terminates inboard of the base perimeter edge, and is thereby hidden when the structure is viewed laterally.

Turning next to FIGS. 28 and 29 of the drawings, still another form of the structural furniture system of the invention is there shown and generally identified by the numeral 180. Structural furniture system 180 here comprises a table construction that includes a first generally planar "U" shaped member 182 having an upper edge 184, spaced apart lateral edges 186 and first slots 188 formed proximate each of the lateral edges (see also FIG. 5). Furniture system 180 also includes second and third generally planar "U" shaped members 190 and 192 that are adapted to be connected to first member 182. Each of the second and third members 190 and 192 has an upper edge 194, lower edges 196, spaced apart lateral edges 198 and connector slots 200 and 202 formed proximate each of the lateral edges (see also FIG. 4). As indicated in FIG. 30, connector slots 202 are constructed and arranged to mateably engage first connector slots 188 of first member 182 to join together the first, second and third members 182, 190 and 192 to form a first precursor structure. In a manner presently to be described, a fourth, or top member 212 is interconnected with first, second and third members to form a second precursor structure.

Also connected to second and third members 190 and 192 is a "U" shaped fifth member 204. Fifth "U" shaped member 204 has an upper edge 206, spaced apart lateral edges 208 and downwardly extending slots 210 formed proximate each of the lateral edges (see also FIG. 6). As indicated in FIG. 30, connector slots 210 are constructed and arranged to mateably engage connector slots 200 of members 190 and 192 to join together members 190 and 192 and 204.

Figure 67:
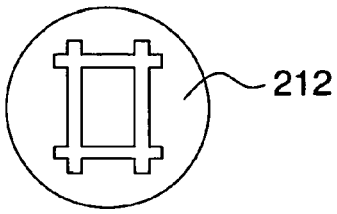
FIG. 67 is a bottom view of a round base in accordance with the present invention, showing how each groove terminates inboard of the base perimeter edge, and is thereby hidden when the structure is viewed laterally.

Connected to the upper edges of members 182, 190, 192 and 204 to form the small end table like structure 180 is the previously mentioned, generally planar, substantially rectangular top, or a fourth member 212. Top member 212 is provided with a plurality of grooves 212*a* that are constructed and arranged to receive the top edges of members 182, 190, 192 and 204. As illustrated in FIG. 67 of the drawings, top member 212 can be circular as well as various other geometric shapes.

Figure 19:
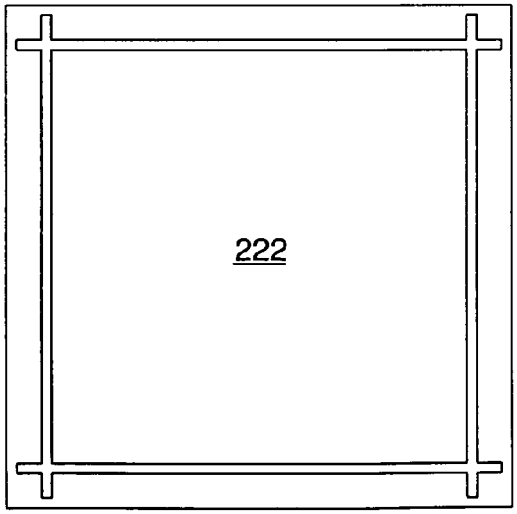
FIG. 19 is another base of the present invention similar to that shown in FIG. 18, but wherein each groove terminates inboard of the base perimeter edge, and is thereby hidden when the structure is viewed laterally.
Figure 31:
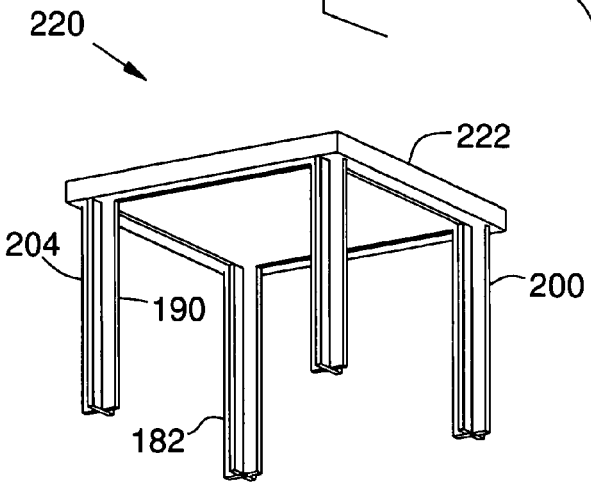
FIG. 31 is a perspective view of the structure of FIG. 30, in assembled form.
Figure 32:
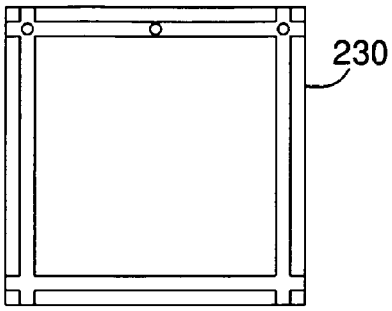
FIG. 32 is a bottom view of a further base which is particularly adapted for use as a component of a chair structure in accordance with the present invention.
Figure 33:
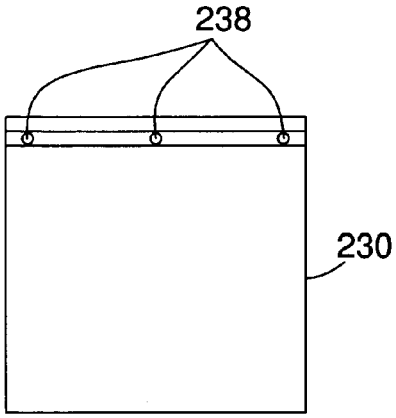
FIG. 33 is a top view of the based shown in FIG. 32.
Figure 34:
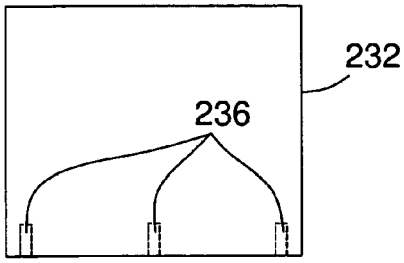
FIG. 34 is a plan view of a further support member which is particularly adapted for use as a chair back component of a chair structure in accordance with the present invention, in association with the base of FIG. 32.

Referring now to FIGS. 30 and 31 of the drawings, yet another form of the structural furniture system of the invention is there shown and generally identified by the numeral 220. Structural furniture system 220, which also comprises a table system, is similar in many respects to the system shown in FIGS. 28 and 29 and like numerals are used in FIGS. 30 and 31 to identify like components. The primary difference between the embodying of the invention shown in FIGS. 28 and 29 and this latest form of the invention resides in the provision of differently configured top member 222. More particularly, top member 222 is provided with a plurality of grooves 222*a* that terminate inboard of the perimeter of the top member and, accordingly, are hidden when the structure is viewed from the side (see also FIG. 19).

Figure 35:
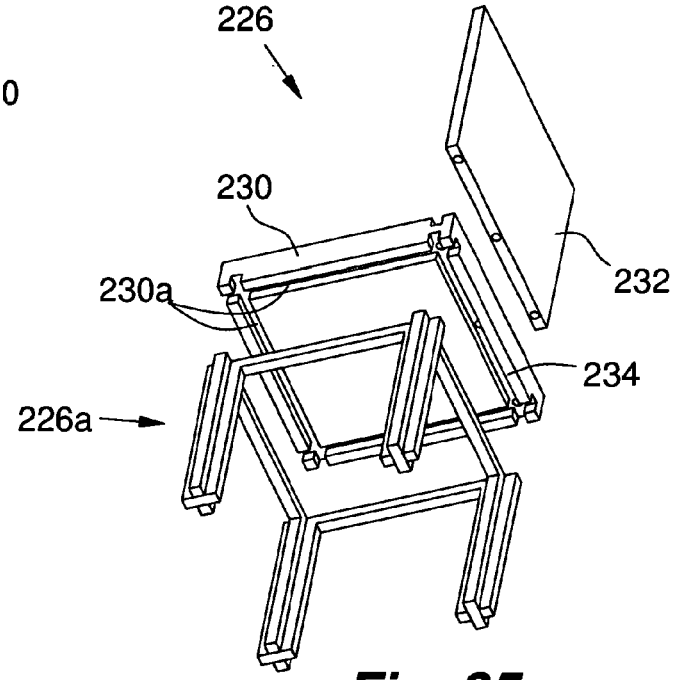
FIG. 35 is an exploded perspective view of a chair structure in accordance with the present invention.
Figure 36:
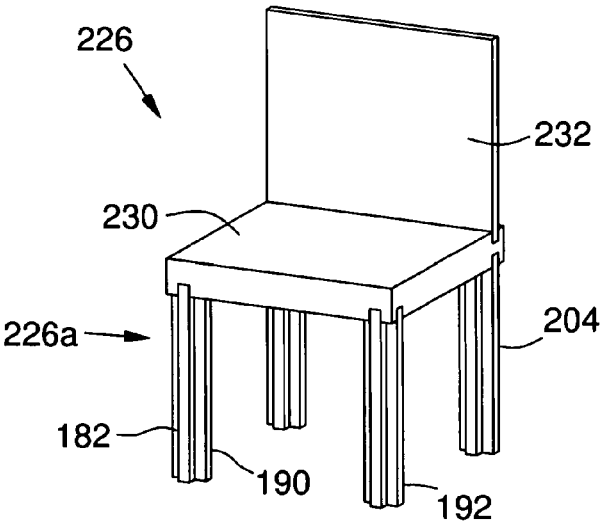
FIG. 36 is a perspective view of the chair structure of FIG. 35, in assembled form.
Figure 37:
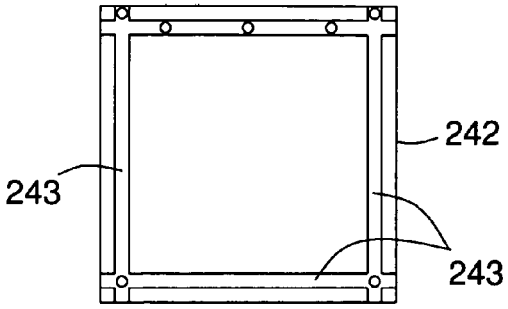
FIG. 37 is a bottom view of a further base which is particularly adapted for use as a component of a chair structure including arm rests in accordance with the present invention.
Figure 38:
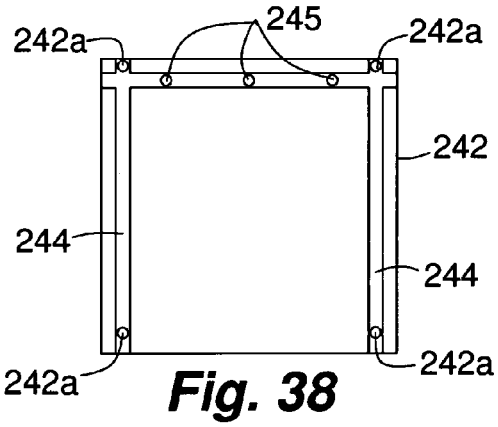
FIG. 38 is a top view of the base shown in FIG. 37.
Figure 39:
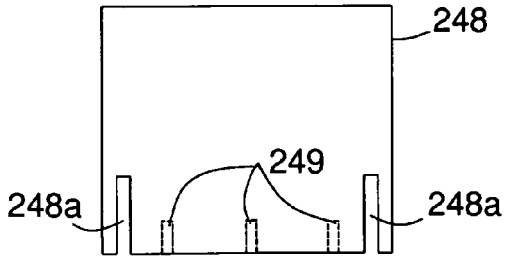
FIG. 39 is a plan view of a further support member which is particularly adapted for use as a chair back component of a chair structure in accordance with the present invention, in association with the base of FIG. 37.
Figure 40:
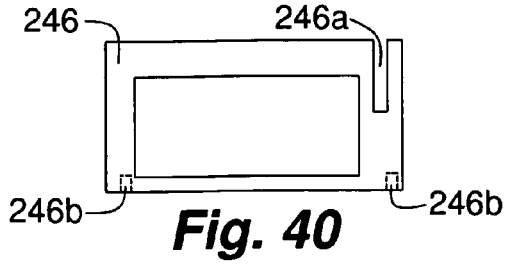
FIG. 40 is a plan view of an arm rest which is particularly adapted for use as a component of a chair structure in accordance with the present invention in association with the base of FIG. 37 and the support structure of FIG. 39.
Figure 41:
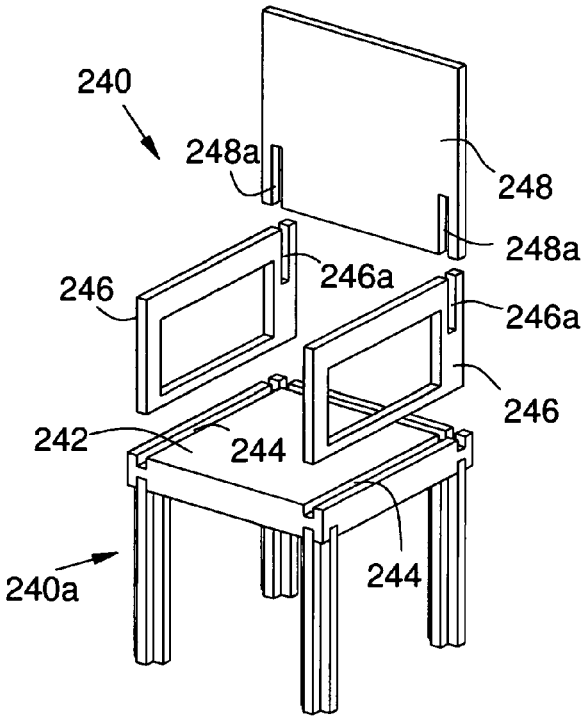
FIG. 41 is an exploded perspective view of a further chair structure in accordance with the present invention incorporating the base of FIG. 37, the support structure of FIG. 39 and the arm rest of FIG. 40.

Turning next to FIGS. 32 through 52, various other forms of the structural furniture system of the invention are there shown. These forms of the structural furniture system, which comprise chairs of several different configurations, function to illustrate the unique flexibility of the system of the invention. As best seen in FIG. 35 of the drawings, seat portion 226*a* of the chair construction 226 there shown is similar to that of the table construction illustrated in FIGS. 30 and 31 and like numerals are used in FIGS. 35 and 36 identify like components. More particularly, the seat portion 226*a* of the chair construction shown in FIG. 35 comprises a first generally planar "U" shaped member 182 having an upper edge, spaced apart lateral edges and first slots formed proximate each of the lateral edges (see also FIG. 5). Seat portion 226*a* also includes second and third generally planar "U" shaped members 190 and 192 that are adapted to be connected to first member 182. Each of the second and third members 190 and 192 has an upper edge, lower edges, spaced apart lateral edges and connector slots formed proximate each of the lateral edges (see also FIG. 4). As earlier discussed, the various connector slots are constructed and arranged so that the first, second and third members 182, 190 and 192 can be readily interconnected to form a first precursor structure.

Figure 6:
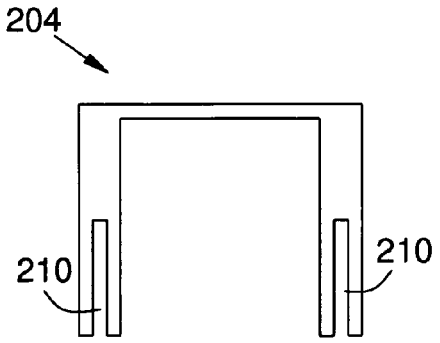
FIG. 6 is a plan view of a further support member in accordance with the present invention, including two leg segments, each leg segment having a down facing slot.

Also connected to second and third members 190 and 192 is a "U" shaped back member 204 having an upper edge, spaced apart lateral edges and downwardly extending slots formed proximate each of the lateral edges (see also FIG. 6). As previously discussed, the various connector slots are constructed and arranged so that members 190 and 192 and 204 can be interconnected to form a second precursor structure.

Connected to the upper edges of members 182, 190, 192 and 204 to form the seat construction 226*a* is a generally planar substantially rectangular seat, or top member 230. Member 230 is provided with a plurality of grooves 230*a* that are constructed and arranged to receive the upper edges of members 182, 190, 192 and 204. Connected to the table like, or seat construction 226*a* to form the chair construction 226 is a back member 232. Back member 232 is received within a groove 234 formed in seat member 230 and is provided with a plurality of transversely spaced apart bores 236, each generally having a threaded insert (not shown).

Bores 236 align with a plurality of transversely spaced apart bores 238 formed in member 230 that are adapted to receive complimentary fasteners such as thumb screws (not shown); a function to provide a stable interconnection between member 232 and seat member 230.

Turning next to FIGS. 37 through 42 of the drawings, another form of chair construction of the present invention is there illustrated. This chair construction, which is generally identified as 240 is similar in many respects to the previously described chair construction and includes a seat construction 240*a* that is made up of the earlier identified members 182, 190, 192 and 204 that are assembled in the manner previously discussed. Affixed to the upper edges of members 182, 190, 192 and 204 is a generally rectangular shaped top, or seat member 242 that is provided on its lower surface with a plurality of grooves 243 (FIG. 37) that receive the upper edges of members 182, 190, 192 and 204. Provided on the upper surface of the seat member is a pair of transversely spaced grooves 244 that are adapted to receive pair of side arm members 246. Each of the side arm members 246 is provided with a slot 246*a*. Interconnected with side arm members 246 is a back member 248 provided with a pair of transversely spaced slots 248*a*.

Figure 42:
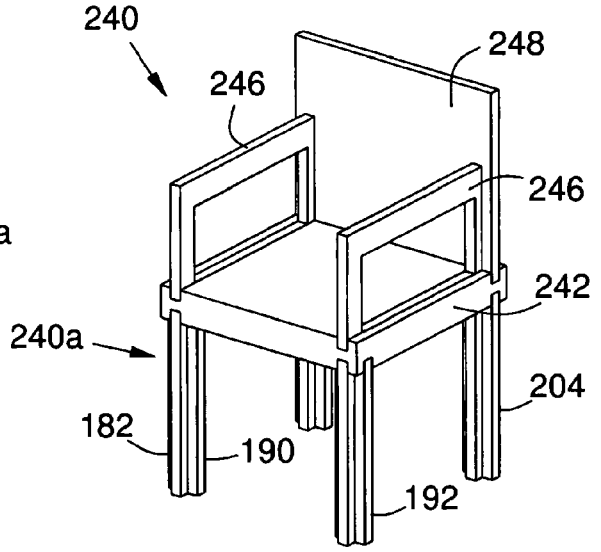
FIG. 42 is a perspective view of the chair structure depicted in FIG. 41, in assembled form.

Slots 248*a* are constructed and arranged to mateably engage connector slots 246*a* formed in side arms 246 to form the chair construction illustrated in FIG. 42 of the drawings.

Back member 248 is provided with a plurality of transversely spaced apart bores 249. Bores 249 each generally contain a threaded insert (not shown) and align with a plurality of transversely spaced apart bores 245 formed in member 242 that are adapted to receive complimentary fasteners such as thumb screws (not shown); a function to provide a stable interconnection between member 248 and seat member 242. Similarly, each of the side arms 246 is provided with bores 246*b* that align with a plurality of spaced apart bores 242*a* formed in member 242. Bores 242*a* and bores 246*b* are adapted to receive dowels or other fasteners (not shown); a function to provide a stable interconnection between members 246 and seat member 242.

Figure 51:
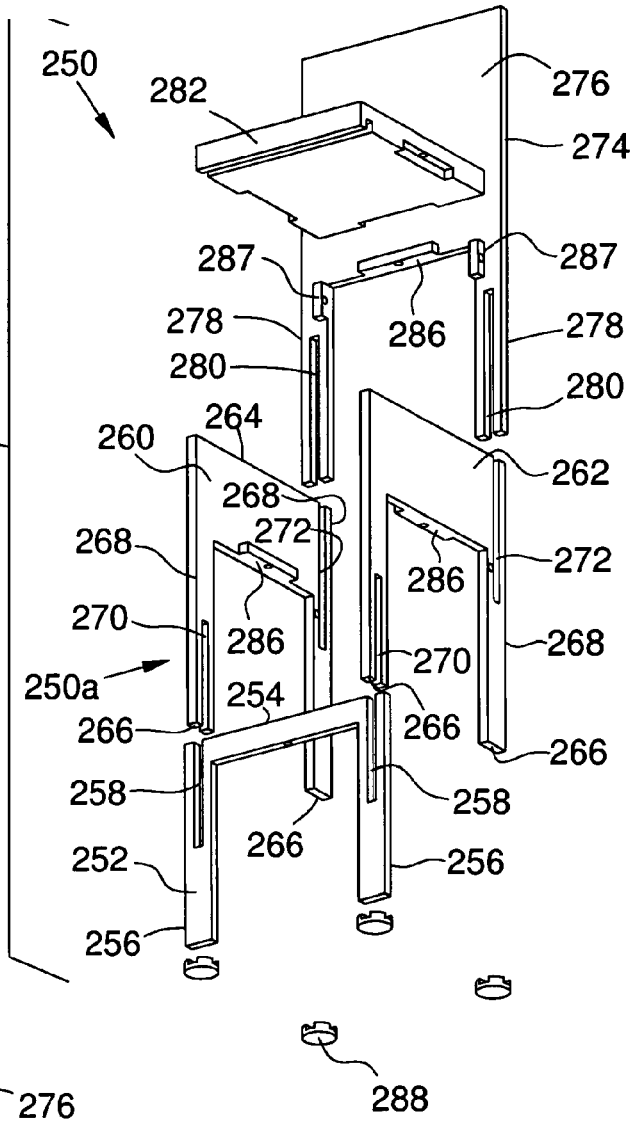
FIG. 51 is an exploded perspective view of a further chair structure in accordance with the present invention incorporating the base of FIG. 47, the support structures of FIGS. 43, 45 and 46 and the attached blocks of FIGS. 49 and 50, and four of the base members of FIG. 12 as feet.
Figure 52:
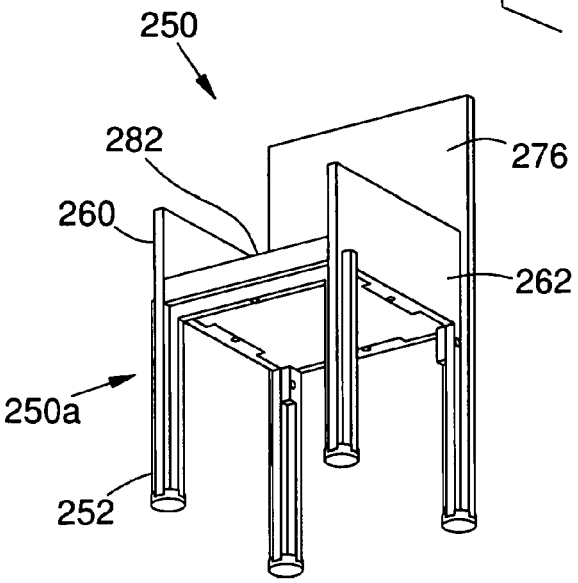
FIG. 52 is a perspective view of the chair structure of FIG. 51, in assembled form.

Referring to FIGS. 43 through 52 of the drawings, still another form of chair construction of the present invention is there illustrated. This chair construction, which is generally identified in FIGS. 51 and 52 as 250 includes a seat construction 250*a* that comprises a first generally planar "U" shaped member 252 having an upper edge 254, spaced apart lateral edges 256 and first slots 258 formed proximate each of the lateral edges. Chair construction 250 also includes second and third generally planar "U" shaped members 260 and 262 that are adapted to be connected to first member 252. Each of the second and third members 260 and 262 has an upper edge 264, lower edges 266, spaced apart lateral edges 268 and connector slots 270 and 272, formed proximate each of the lateral edges. As indicated in FIG. 51, connector slots 270 are constructed and arranged to mateably engage first connector slots 258 of first member 252 to join together the first, second and third members 252, 260 and 262 to form a first precursor structure. In a manner presently be described, a fourth, or seat member is interconnected with a first second and third member to form a second precursor structure.

Also connected to second and third members 260 and 262 is a "U" shaped fifth member 274. Fifth "U" shaped member 274 has an upper seat back portion 276 and spaced apart leg portions 278 each having downwardly extending slots 280. As indicated in FIG. 51, connector slots 280 are constructed and arranged to mateably engage connector slots 272 of members 260 and 262 to join together members 260 and 262 and 274.

Connected to members 256, 260, 262 and 274 by presently to be identified connector brackets to form the chair structure 250 is the previously mentioned, generally planar, substantially rectangular seat, or a fourth member 282.

Figure 20A:
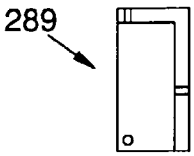
FIG. 20A is a bracket in accordance with the present invention, which may be used along with fasteners to provide additional structural rigidity for a number of structures of the present invention where necessary or desirable.
Figure 20B:
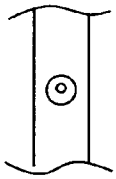
FIG. 20B is a fragmentary enlarged view of a clearance hole within a structure in accordance with the present invention.
Figure 43:
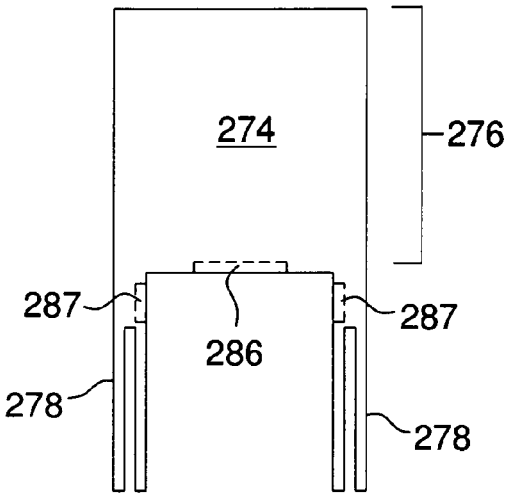
FIG. 43 is a plan view of a further support member with two leg segments, each with down facing slots, and which is particularly adapted for use as a chair back and a portion of two legs of a chair structure in accordance with the present invention.
Figure 44:
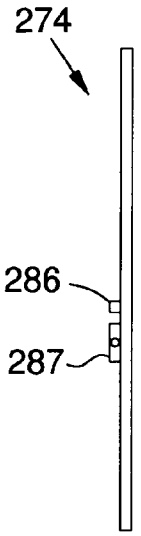
FIG. 44 is a side view of the support member shown in FIG. 43 which also illustrates the assembled positioning of two attached blocks to the support member.
Figure 49:
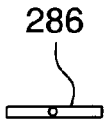
FIG. 49 is a plan view of an attached block with a clearance bore by which support members are secured to a base in particular structures according to the present invention.
Figure 45:
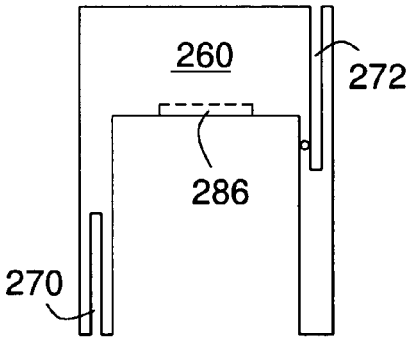
FIG. 45 is a plan view of a support structure with two leg segments, one down facing slot and one up facing slot, and which is particularly adapted for use as an arm rest and as a portion of two legs of a chair structure in accordance with the present invention.
Figure 47:
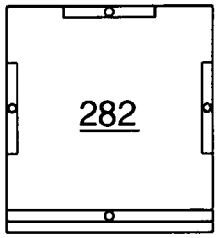
FIG. 47 is a bottom view of a further base which is particularly adapted for use as a component of a chair structure in accordance with the present invention in which component intersections are reinforced using attached blocks and fasteners.
Figure 50:
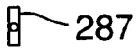
FIG. 50 is a plan view of a further attached block with a clearance bore by which support members are secured to a base in particular structures according to the present invention.
Figure 46:
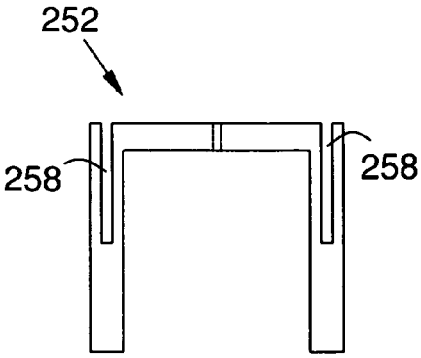
FIG. 46 is a plan view of a further support structure with two leg segments and two up facing slots, and which is particularly adapted for use as a front portion of a chair structure in accordance with the present invention.
Figure 48:
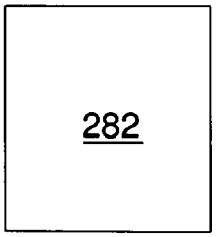
FIG. 48 is a top view of the base of FIG. 47, further depicting four clearance holes to be axially aligned with the holes positioned in respective attached blocks.

To provide attachment points and support for member 282, support blocks 286 and 287 (FIGS. 49 and 50) are affixed to members 260 and 274 at locations indicated in FIGS. 43, 44 and 45 of the drawings. Additionally, as illustrated in the drawings, clearance bores are strategically located to allow conventional fasteners to be used to provide additional structural rigidity for the chair. Threaded inserts can be securely positioned within the bore of one member, for example by press fit or adhesive, such that the member may receive a bolt, a thumb screw, or similar complimentary threaded fastener through the clearance bore associated with an adjoining member, thereby rigidly fastening the two members together. In chair structure 250 (shown in FIGS. 51 and 52), for example, the four bores in member 282 each have such a threaded insert placed within them (not shown), and member 252 and supports blocks 286 and 287 each include a corresponding clearance bore through which a thumb screw fastener (not shown) can be introduced and mated with the respective threaded insert in member 252. FIG. 20A of the drawings illustrates another type of bracket 289 that can be used along with the conventional fasteners to provide additional structural rigidity. FIG. 20B is a fragmentary enlarged view of a typical clearance bore. Further, foot bases 288 are affixed to the legs of the chair to provide additional protection for the floor surface upon which the chair will be used. These foot bases can be used in a similar fashion in connection with other structures of the present invention.

Figure 18:
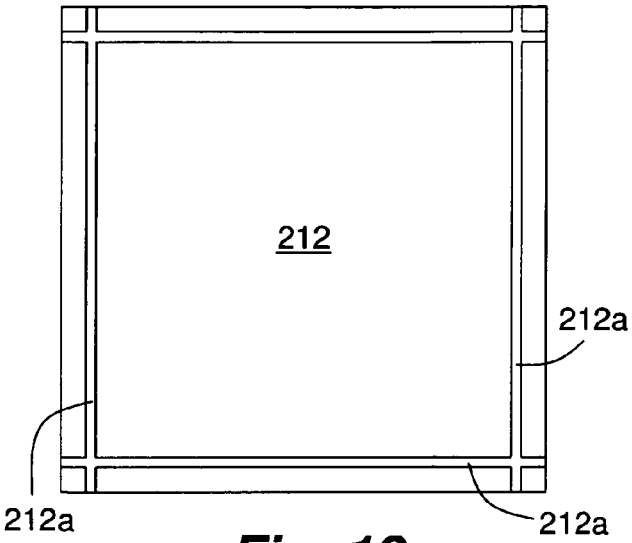
FIG. 18 is another base in accordance with the present invention similar to that shown in FIG. 10, but larger, making it more suitable for tabletop applications.
Figure 21:
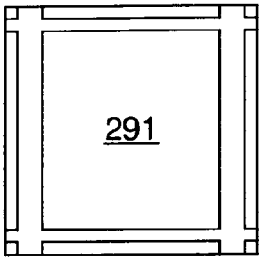
FIG. 21 is a bottom view of a base in accordance with the present invention with a similar groove pattern as the base of FIG. 18, but wherein the two lateral grooves are wider to interface with a thicker structural member.

FIG. 21 is a bottom view of a slightly differently configured seat 291 showing a similar groove pattern to that shown in FIG. 18, but wherein the two lateral grooves are wider to interface with a thicker structural member.

Figure 22:
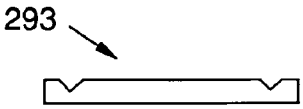
FIG. 22 is a side view of a base similar to that shown in FIG. 21, but wherein the two lateral grooves are cut in a V shaped pattern to help guide the respective support member into the groove.

FIG. 22 is a side view of a seat 293 similar to that shown in FIG. 21, but wherein the two lateral grooves are cut in a "V" shaped pattern to help guide the respective support member into the groove.

Figure 23:
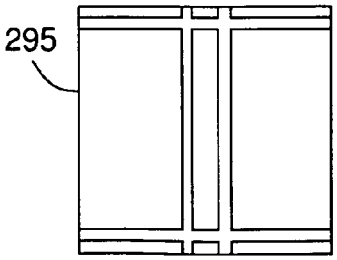
FIG. 23 is a bottom view of another base in accordance with the present invention which is particularly suited to form a center base of a multiple base structure.

FIG. 23 is a bottom view of a base 295 of still a different configuration.

Figure 59A:
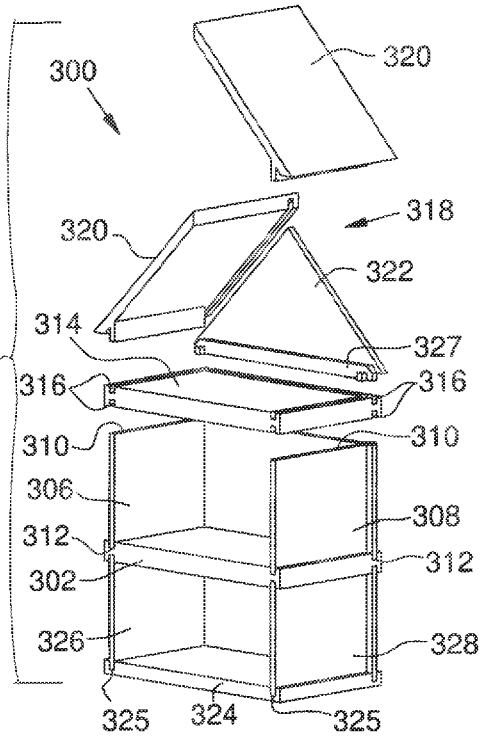
FIG. 59A is an exploded perspective view of a dollhouse structure in accordance with the present invention incorporating a triangle roof piece and two roof sections.
Figure 59B:
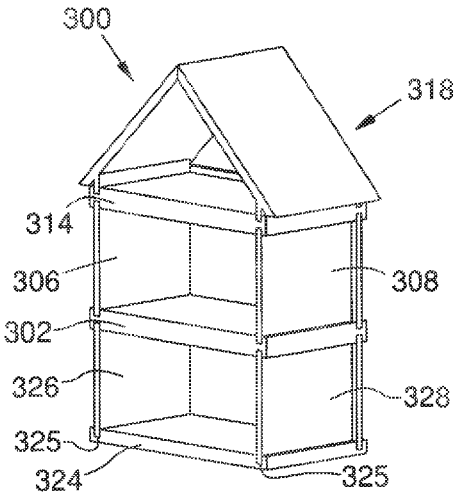
FIG. 59B is a perspective view of a dollhouse structure depicted in FIG. 59, in assembled form.

Referring now to FIGS. 53 through 67, still another form of the structural system of the invention is there shown and generally designated in FIGS. 59 and 60 by the numeral 300. Structural system 300, which is in the form of a doll house, comprises a first floor member 302 having a plurality of spaced apart grooves 304 and first and second spaced apart side members 306 and 308 that are connected to the first floor member 302 in the manner shown in the drawings. As shown in exploded view FIG. 59A and assembled view in 59B, first and second side members 306 and 308 each have an upper edge 310 and a lower edge 312, the lower edge being received within selected ones of the plurality of spaced apart grooves 304 of the first floor member 302.

Figure 53:
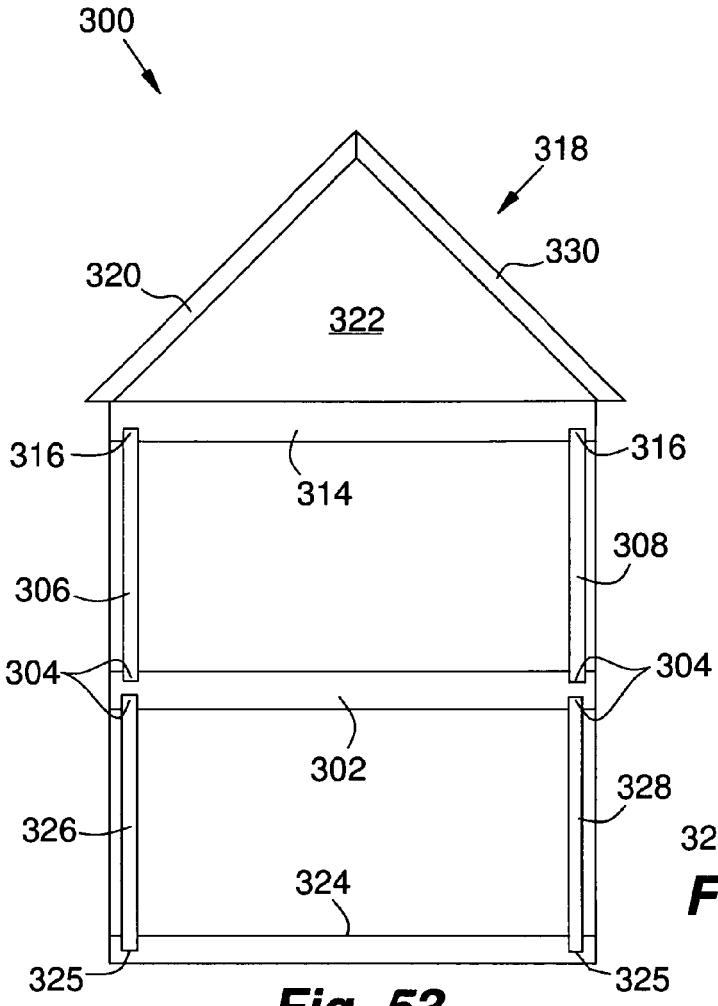
FIG. 53 is a front view of a two story dollhouse structure in accordance with the present invention.
Figure 54:
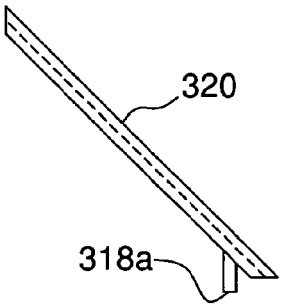
FIG. 54 is a front view of a roof section of the dollhouse structure depicted in FIG. 53.
Figure 55:
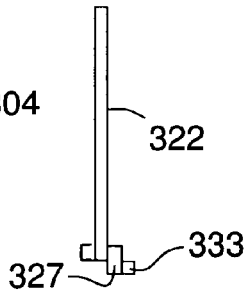
FIG. 55 is a side view of a triangle roof piece of the dollhouse structure depicted in FIG. 53.

Connected to the top edges of the first and second spaced apart side members 306 and 308 is a ceiling member 314 having a plurality of spaced apart grooves 316 (FIG. 59A). As illustrated in FIGS. 53 and 63, the upper edges of the side members are received within selected ones of the grooves 316 formed in ceiling member 314.

Connected to ceiling member 314 is a slanted roof structure 318 having edges 318*a* receivable within selected ones of the grooves 316 formed in the ceiling member. Slanted roof structure 318 comprises interconnected side panels 320 and an end panel 322 that is interconnected with the side panels and with the ceiling member 314. End panel 322 includes a long edge piece 327 which is receivable by a groove in ceiling member 314, and two short edge pieces 333 which are receivable by two opposing grooves in ceiling member 314 (see FIGS. 55, 58 and 59).

As illustrated in FIG. 59, structural system 300 further includes a second floor member 324 having a plurality of grooves 325 and third and fourth side members 326 and 328. Side members are connected to and disposed between the first and second floor members in a manner illustrated in the drawings.

Figure 56:
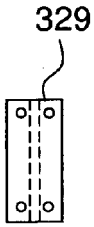
FIG. 56 is a plan view of a bracket for use in securing adjacent bases and support members of particular structures in accordance with the present invention.

FIG. 56 is a plan view of a bracket 329 for use in securing adjacent structural members of particular structures in accordance with the present invention.

Figure 57:
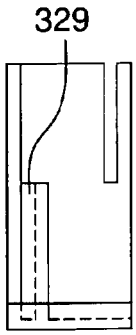
FIG. 57 is a partial side view depicting the intersection of a wall section and a support member secured together with a bracket.
Figure 58:
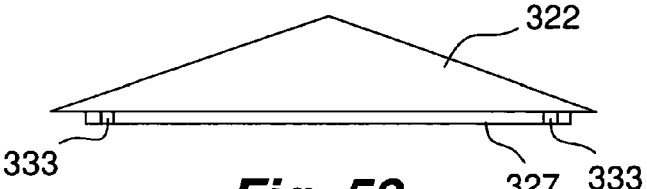
FIG. 58 is a side view of a further base which can be used as a roof in association with a dollhouse structure in accordance with the present invention if an attic is not desired.

FIG. 57 is a partial side view depicting the intersection of a typical wall section and a typical structural member secured together with a bracket.

Figure 60A:
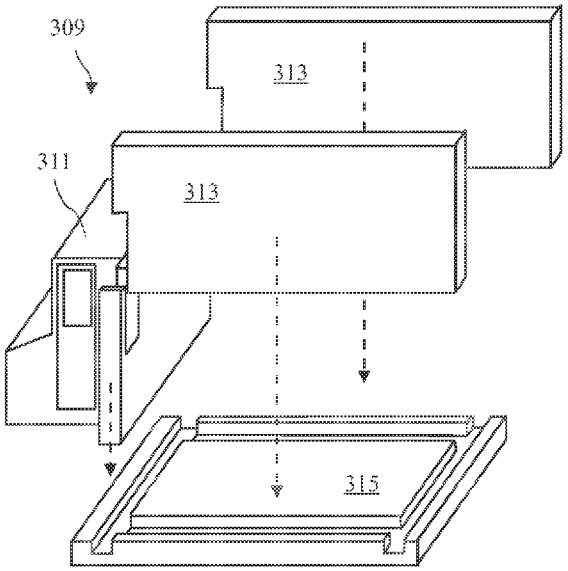
FIG. 60A is an exploded view of a toy truck according to the present invention.
Figure 60B:
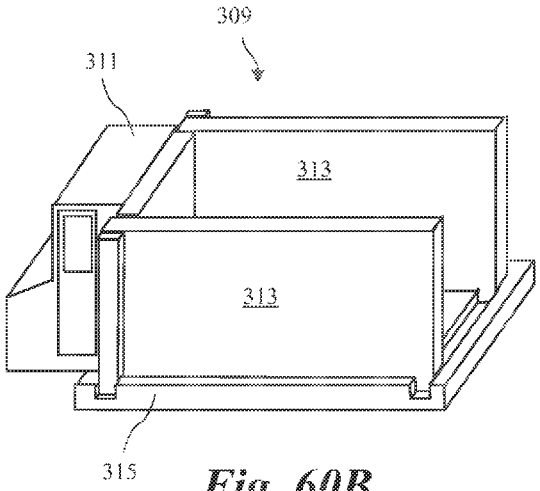
FIG. 60B is an assembled view of the toy truck according to the present invention.

FIG. 60A is an exploded view of a toy truck 309 and FIG. 60B is an assembled view of the toy truck 309. The toy truck 309 is assembled from a cab piece 311, wall pieces 313, and a bed piece 315, using the methods of the present invention. The bed 315 may include holes through it to allow insertions of axles to be attached to wheels.

Figure 64:
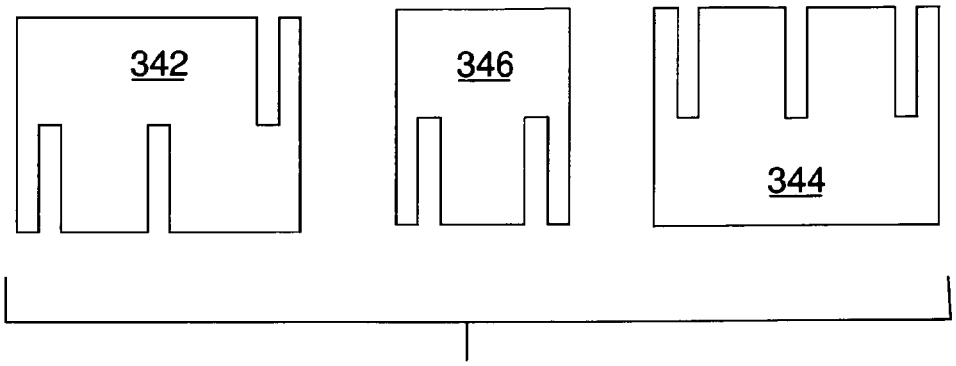
FIG. 64 depicts three further support members with slots in accordance with the present invention.
Figure 65:
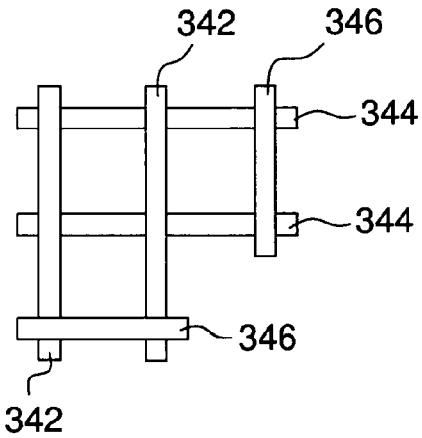
FIG. 65 is a top view of a further structure in accordance with the present invention, and incorporating the support members depicted in FIG. 64.
Figure 66:
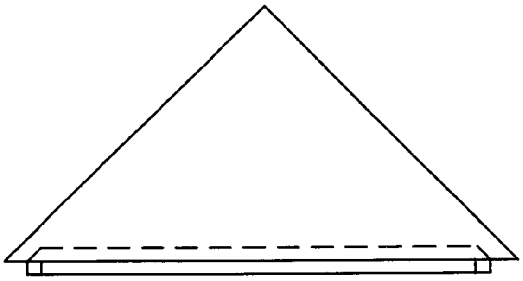
FIG. 66 is a plan view of the triangular roof structure depicted in FIG. 55.

FIGS. 61 and 62 illustrate various ways in which the various structural members of the present invention can be laterally interconnected to expand the length and width of a given structure as may desired for a particular application. For example, base 332 can be joined between two bases 331, and base 295 (shown in FIG. 23) can be joined between two bases 330. For example, such bases can be fastened together rigidly or semi-rigidly using the previously-mention threaded inserts in association with base 332 at positions indicated in FIG. 61 by dotted lines. When base 332 and 331 are mated, the joint may be secured by way of a bolt, thumb screw or other complimentary threaded fastener placed through a bore located in each of the two opposing lateral sides of base 331 in axial alignment with the threaded inserts of base 332. Ultimately, placement of support members into the respective grooves of the bases will also contribute to maintaining the interconnection of the bases. A bracket 340 shown in FIG. 62A may also be used to provide additional structural rigidity when needed. FIGS. 64 and 65 illustrate how the support members 342, 344, and 346 can be used to create multi-room or multi-cell structures.

FIG. 63A depicts a plan view of a panel having recesses in a slot 335 adapted to improve the rigidity of a structure assembled in accordance with the present invention, FIG. 63B depicts a plan view of a cooperating panel having protrusions on a surface adapted to improve the rigidity of a structure assembled in accordance with the present invention, and FIG. 63C depicts an edge view of the cooperating panel having the protrusions on the surface adapted to improve the rigidity of a structure assembled in accordance with the present invention. The recesses 360 and cooperating protrusions 359 help secure panels after joining. The recesses 360 may be in a slot 335 and the protrusions may be on panel surfaces 337, or visa versa. When the panels are connected, the protrusion enter the recesses in the slots and resist disassembly of the panels.

FIG. 63D depicts a top or bottom base edge of a panel 338 having protrusions 359 on legs 339*a* separated by a horizontal panel base groove 339*b*, cooperating with recesses 360*a* in a horizontal floor (or roof) groove 360*b*. The bottom edge of the panel 338 may be rounded to make insertion into the groove 360*b* easier.

The material used for manufacture of the structural members of the present invention can be anything from plastic to metal. The two structural members 334 and 336 show the cooperating recesses 360 and protrusions 362. The recesses 360 in structural member 334 ride up over and centers on top of the protrusions 362 on structural member 336. The recesses 360 in structural member 334 can be formed by drilling a hole before cutting the groove. The protrusions 362 on structural member 336 may be the head of a pin or a small smooth rivet. Structural member base 338 represents an edge of a structural member which may be inserted into a groove of a base. Support 340 shows four rivets, two on each end near the two ends of a support member. Two holes are drilled in each end of the base before the groove is cut. The amount of rigidity obtained is dependent on the thickness of the support members, the size of the rivets and the mating curvature. Alternatively, injection molding could form these areas in the plastic or material. The mating areas could then cover a large area end to end or side to side.

The various structural members can have decorative cuts for their shapes and cuts and designs on the surfaces. By adding drawers to the bookcase, it becomes a chest of drawers. Support members can also feature cutouts for doors and windows to produce, for example, a large outdoor playhouse. A hallway can be assembled to connect two rooms of playhouse by using two structural members inserted into up facing slots of the walls of each room with doorways between the slots. The playhouse could be made of thick, soft foam pieces for small children who would enjoy falling into the walls and seeing the house move. Stiff foam and other materials could be used for older children.

The components of the present invention can be injection molded. The outside surfaces of the structural members can have the shape of a train locomotive and cars, trucks, etc. The bottom base could have means for attaching wheels. Construction game puzzles are yet another use of this method of design and construction techniques. The bases can have groove patterns of any geometrical shape. Also the structural members could have no grooves at all. They could be like a cover or lid with a perimeter which fits on the outside of the structural members. Also, the base could be flat with a center section that fits inside the structural members.

Some or all of the slots in the structural members may, in some instances, be V-shaped. This shape is self centering and helps in locating the slots. All the slots could be V-shaped or any other of many possible shapes. All sharp edges can be rounded for ease of assembly. There are applications when tables or other objects need to be moved on smooth floors, or kept off of delicate surfaces. In such cases, bottom members 140, 142 or 144 (see FIGS. 12-17) can be applied to the bottom or feet of the object to be moved to protect the surface.

Figure 68:
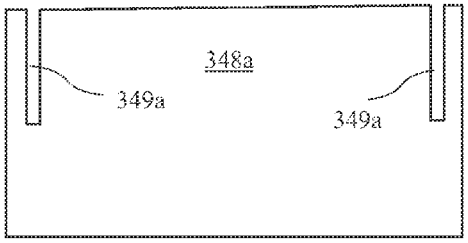
FIG. 68 shows a first structural member according to the present invention.

FIG. 68 shows a first structural member 348*a*. The structural member 348*a* includes two upward facing slots 349*a*.

Figure 69:
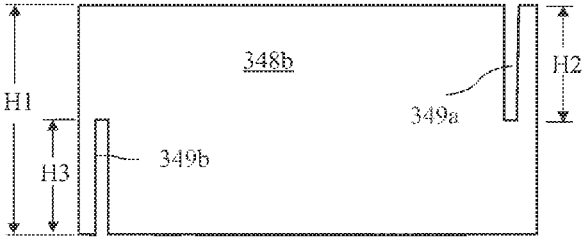
FIG. 69 shows a second structural member according to the present invention.

FIG. 69 shows a second structural member 348*b*. The structural member 348*b* includes a downward facing slot 349*b* and an upward facing slot 149*a*. The structural members have a height H which varies based in the structure being built. The upward facing slot 349*a* has a height H2 and the downward facing slot 349*b* has a height H3. The height H2 and heights H3 preferably sum to at least the height H, and more preferably to about the height H, and most preferably, both the height H2 and the height h3 are about half the height H.

Figure 70:
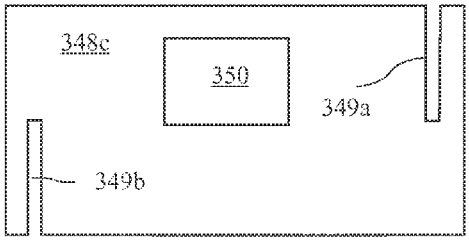
FIG. 70 shows a third structural member according to the present invention.

FIG. 70 shows a third structural member 348*c*. The structural member 348*c* includes an upward facing slot 349*a*, a downward facing slot 349*b*, and a window 350.

Figure 71:
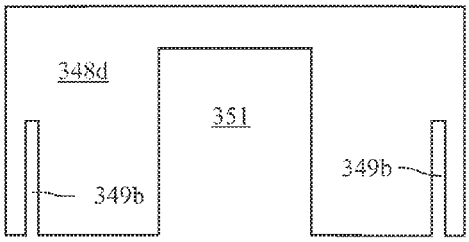
FIG. 71 shows a fourth structural member according to the present invention.

FIG. 71 shows a fourth (or completing) structural member 349*d*. The structural member 348*d* includes two downward facing slots 349*b* and may include a doorway 351. The two downward facing slots 349*b* allow the fourth structural member 349*d* to simultaneously engage two other previously engaged structural members having open upward facing slots.

Figure 72:
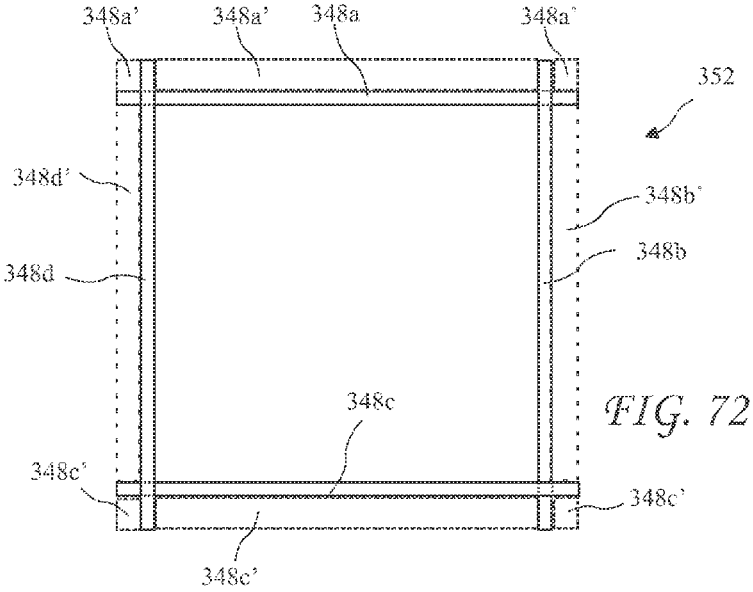
FIG. 72 shows a top view of a structure according to the present invention constructed from the first, second, third, and fourth structural members.
Figures 82, 82A:
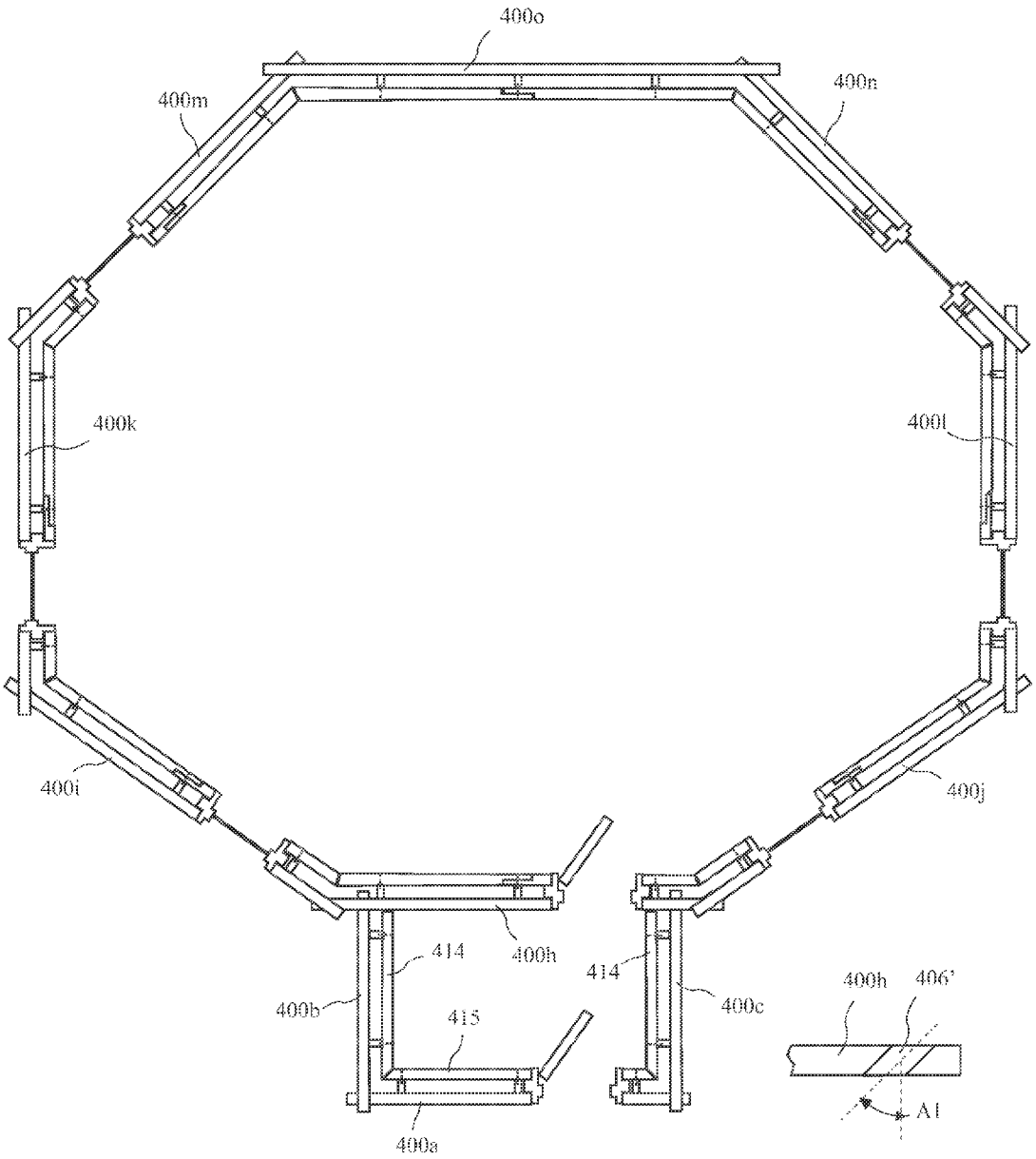
FIG. 82 shows a top view of a two room structure constructed using the second structural members and inner panels, and including an octagonal room, according to the present invention.
FIG. 82A shows a panel with an angled slot according to the present invention.

FIG. 72 shows a top view of a structure 352 constructed from the first, second, third, and fourth structural members 348*a*, 348*b*, 348*c*, and 348*d*. The fourth structural member 349*d* completed the room (or other structure) 352 by engaging the first structural member 348*a*. The slots 349*a* and 349*b* are constructed with edges 90 degrees from faces of the structural members resulting the connected structural members being generally at 90 degree angles. Such 90 degree angles are not necessary qualities of the present invention, and the slots 349*a* and 349*b* may be at other angles, for example 60 degrees, to construct a hexagonal structure, and such construction is intended to come within the scope of the present invention. For example, FIG. 82 shows an eight sided structure and FIG. 82A shows slot 406' at a 45 degree angle for constructing the eight sided structure. The thickness of each structural member may also be increased to increase the rigidity of the structure due to added contact area.

Figure 1:
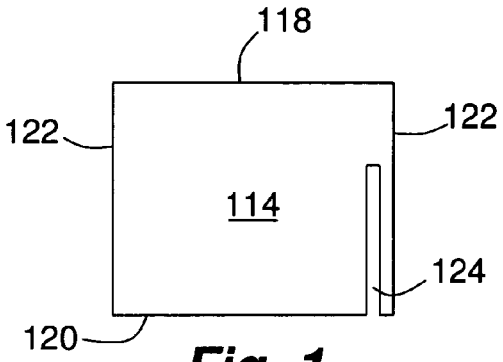
FIG. 1 is a plan view of a support member in accordance with the present invention including a down facing slot.
Figure 4:
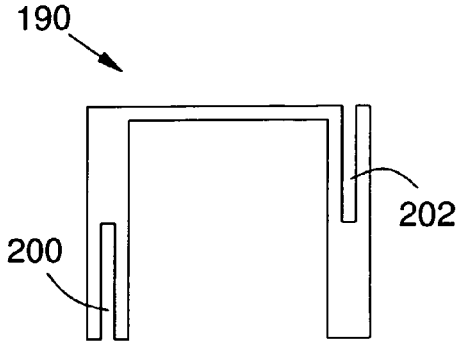
FIG. 4 is a plan view of a further support member in accordance with the present invention including two leg segments, one leg segment having an up facing slot and the other having a down facing slot.
Figure 5:
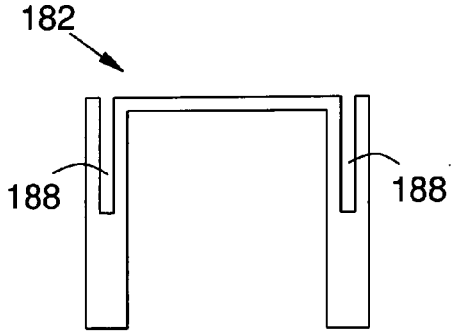
FIG. 5 is a plan view of a further support member in accordance with the present invention including two leg segments, each leg segment having an up facing slot.
Figure 3:
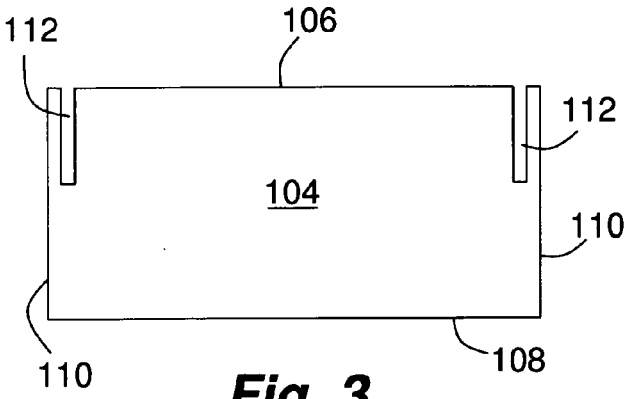
FIG. 3 is a plan view of a further support member in accordance with the present invention including two up facing slots.
Figure 79:
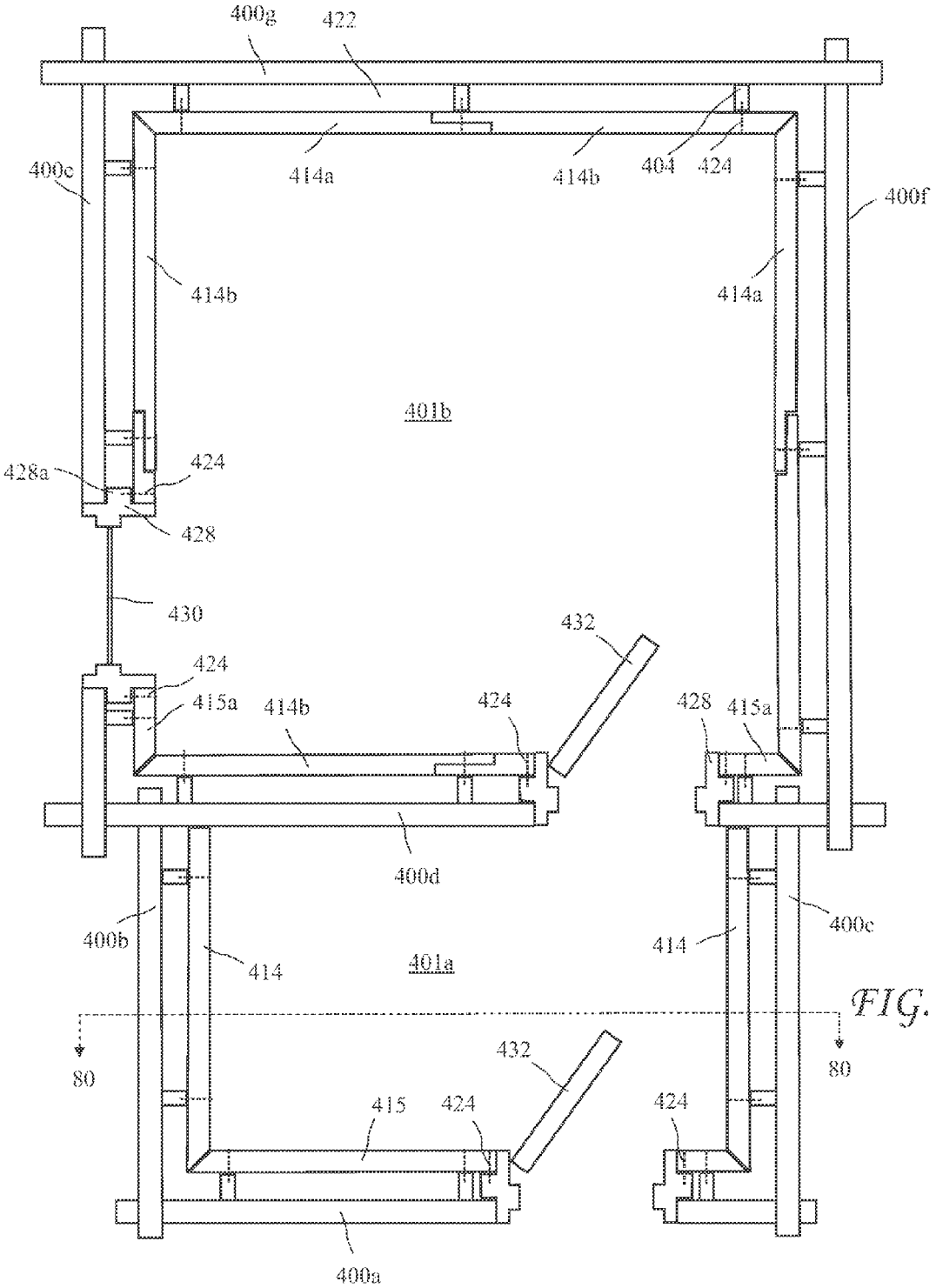
FIG. 79 shows a top view of a two room structure constructed using the second structural members and inner panels according to the present invention.

Further, one or more of the structural panels 348*a*, 348*b*, 348*c*, and 348*d* used to construct the structure 372 may be replaced by the hollow pieces shown in FIGS. 4, 5, and 6 and adding outer and inner wall pieces to this perimeter in the same manner as shown in FIG. 79 for the inner wall pieces or using stock 4 ft. by 8 ft. panels. The inner wall pieces of FIG. 79 can be attached to both sides of the structural panels 348*a*, 348*b*, 348*c*, and 348*d* with hardware and protrusions and the outer wall pieces thus produced can be located into the floor and roof grooves of the house. The perimeter would also be located in short grooves in the floor and the roof in the middle of the inner and outer walls. Constructing the structure 372 using hollow panels reduces weight and may eliminate the need of a crane for assembly or disassembly of the structure 372.

The structural panels 348*a*, 348*b*, 348*c*, and 348*d* may further be modified adding material 348*a*', 348*b*', 348*c*', and 348*d*' shown in dashed lines to the panels 348*a*, 348*b*, 348*c*, and 348*d* providing a straight line perimeter and improving rigidity.

Figure 72A:
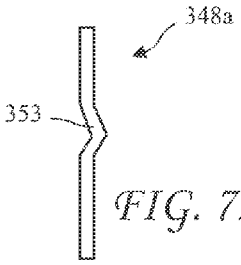
FIG. 72A shows a structural member with a "V" shaped bend to increase structural rigidity.

The shape of the structural members may be manipulated to obtain many different structures can continue in other ways and each structural member can be formed in any desired shape. Each of the structural members can bend and twist in any direction horizontally or vertically. For Example, piece 348*a* could have a 360 degree twist in the middle of it and still connect to pieces 348*b* and 348*d* because the orientation of the slots would be the same. A modified piece 348*a* is shown in FIG. 72A with a "V" shapes bend 353 to add rigidity. Such "V" shaped bend may be vertical or horizontal or both vertical and horizontal to add a desired rigidity.

Internal bracing of the assembled structural members may further be accomplished by installing three way "L" brackets in each corner of every room of the structure, and two way "L" brackets at each adjoining wall located at the mid-section of each structural member. The "L" brackets can be connected to spacers 404 (see FIGS. 77A and 77B) located on the walls, floor and roof pieces when the structural members are injection molded. Threaded spacers can be used for other materials. External bracing of the perimeter of the structure can be accomplished by connecting posts to each corner of the structure which are secured to each adjoining structural member and to the bottom of the overhanging roof and to a cutout in the floor and it extends into the ground and is covered with cement. The posts may be four inch square posts or larger which engage both adjoining structural members. Additional rigidity can be obtained by attaching posts to the middle of all exterior walls in the same manner as the corner posts.

Figure 73:
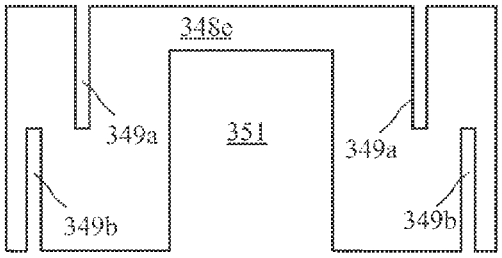
FIG. 73 shows an alternative fourth structural member according to the present invention.

FIG. 73 shows an alternative fourth (or shared) structural member 348*e*. The structural member 348*e* additionally includes two upward facing slots 349*a*.

Figure 74:
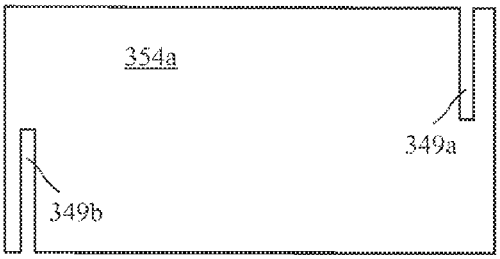
FIG. 74 shows a fifth structural member according to the present invention.

FIG. 74 shows a fifth structural member 354*a*. The structural member 354*a* includes a downward facing slot 349*b* and an upward facing slot 349*a*.

Figure 75:
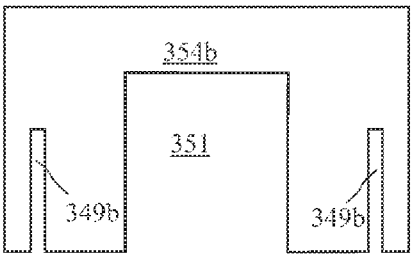
FIG. 75 shows a sixth structural member according to the present invention.

FIG. 75 shows a sixth structural member 354*b*. The structural member 354*b* includes two downward facing slots 349*b* and a doorway 351.

Figure 76:
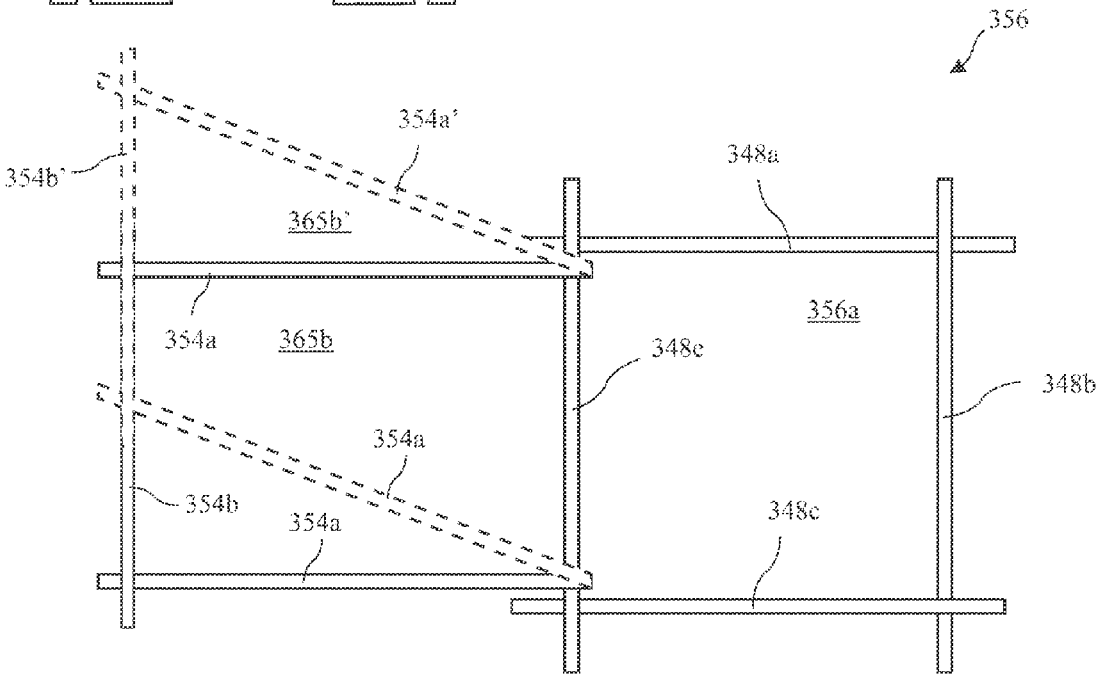
FIG. 76 shows a top view of a structure according to the present invention constructed from the first, second, third, alternative fourth, fifth, and sixth structural members.

FIG. 76 shows a top view of a structure 356 constructed from the first, second, third structural members 348*a*, 348*b*, and 348*c*, the alternative fourth structural members 348*e*, two of the fifth structural members 354*a*, and the sixth structural member 354*b*, providing a first room 365*a* and a second room 365*b*. Additional rooms may be similarly added to the structure 356 by providing two additional upward facing slots 349*a*. The structure 356 is constructed by adding the two fifth structural members 354*a* to the stable structure 352, and then adding the sixth structural member 354*b*. While the added second room 365*b* has walls parallel to the walls of the first room 365*a*, Panels 354*a*' and 354*b*' may also be attached to panel 348*e* creating an angled room 365*b*'. Those skilled in the art will recognize that various angles and meandering multi-room structures may be created using the panels and methods of the present invention.

Figure 76A:
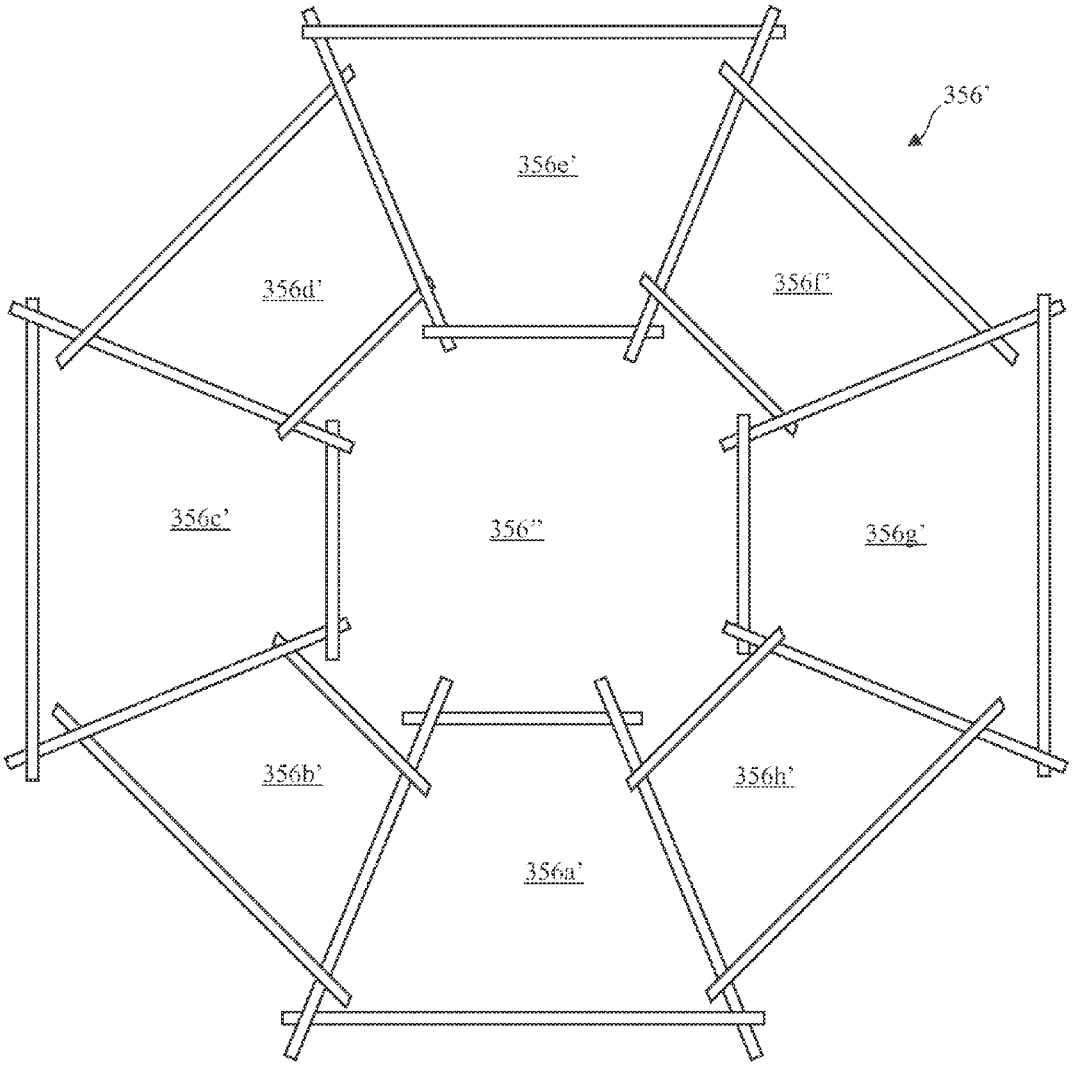
FIG. 76A shows an octagonal structure according to the present invention' having eight consecutively constructed rooms.

FIG. 76A shows an octagonal structure 356' having eight rooms 356*a*', 356*b*', 356*c*', 356*d*', 356*e*', 356*f*', 356*g*' and 356*h*'. The room 365*a*' is constructed in the same manner as the room 356*s* in FIG. 76, but with angled walls. The rooms 356*b*', 356*c*', 356*d*', 356*e*', 356*f*', 356*g*' are added consecutively, and the final room 356*h*' connects to the first room 356*a*' to complete the structure. A center area 365" may be a ninth room or an atrium. The first complete room 356*a*' provides a stable base for adding the additional rooms minimizing construction effort.

Figure 77C:
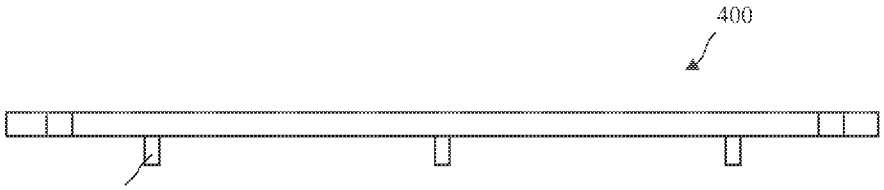
FIG. 77C shows a top view of the second structural member including the spacers according to the present invention.
Figure 77A:
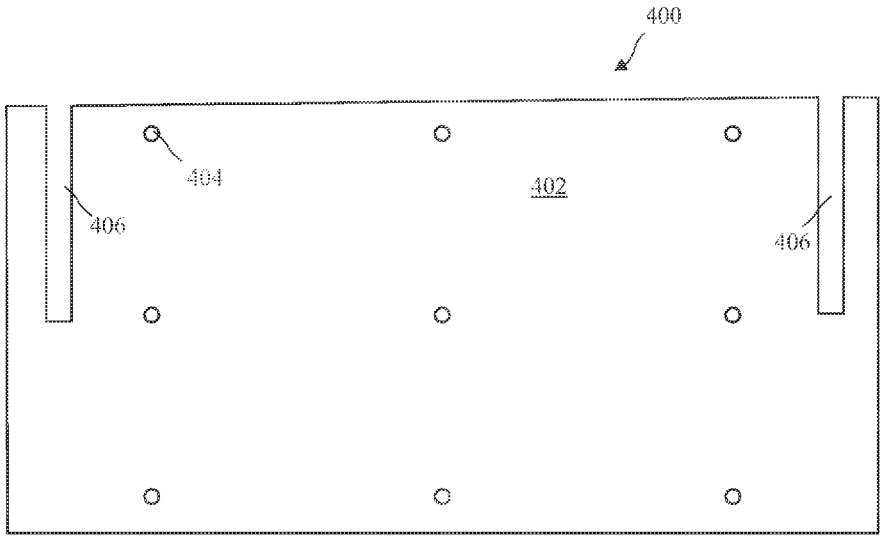
FIG. 77A shows an inside view of a second structural member including spacers according to the present invention.
Figure 77B:
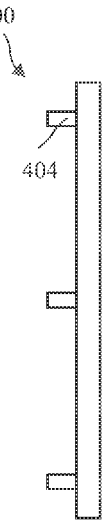
FIG. 77B shows a side view of the second structural member including the spacers according to the present invention.

FIG. 77A shows an inside view of a second structural member 400 including spacers 404 according to the present invention, FIG. 77B shows a side view of the structural member 400, and FIG. 77C shows a top view of the structural member 400. The structural member 400 is shown with two upward facing slots 406, but may have two downward facing slots as shown in FIG. 75, or one upward and one downward facing slot as shown in FIG. 74. The structural member 400 may further include a doorway 351 or a window opening 350, or both a doorway and window opening. A number of the spacers 404 are vertically and horizontally spaced apart and preferably permanently attached on the inside surface of the structural member 400.

Figure 78:
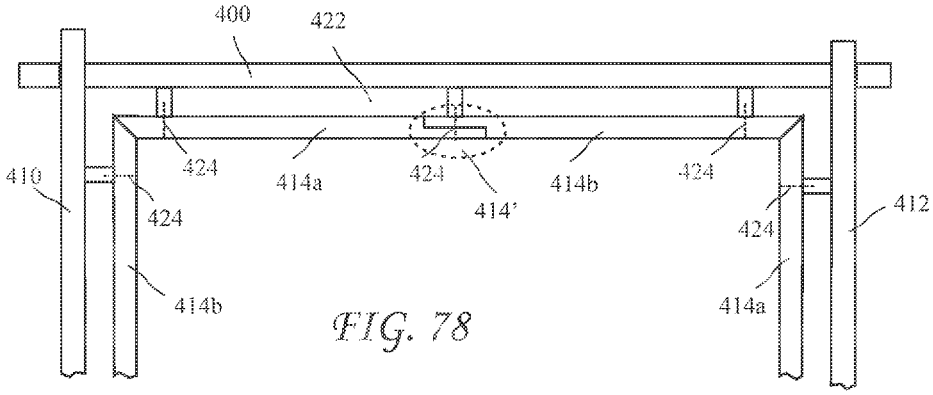
FIG. 78 shows a top view of the second structural member having inner panels attached to the spacers according to the present invention.

FIG. 78 shows a room partition 347 for dividing a single room into two rooms and FIG. 78 shows the room partition 347 dividing room 356*a* into two rooms. The room partition 347 includes two downwardly open slots 349*b* for engaging upwardly open slots 349*a* (not shown) in two of the engaged structural members. The room partition 347 may include a doorway 351.

FIGS. 78A and 78B show two cooperating partitions for dividing a single room into four rooms.

FIG. 78 shows a top view of the structural member 400 having inner panels 414*a* and 414*b* attached to the spacers 404. The spacers 404 are preferably between two and six inches long, and more preferably about four inches long and provide a space 422 between the structural member 400 and the inner panels 414*a* and 414*b*. The space 422 is provided for insulation, electrical, and plumbing. The inner panels 414*a* and 414*b* may be attached to the spacers by bolts, screws, adhesive, and the like, and are preferably attached by screws 424. For easy installation, the inner panels 414*a* and 414*b* may overlap at 414' and single fasteners 424 may reach through overlapped portions of through both inner panels 414*a* and 414*b*.

FIG. 79 shows a top view of a two room structure constructed using the second structural members and inner panels having interiors 401*a* and 401*b*. The structural members are selected to allow easy assembly by a single adult. For example, a first structural member 400*a* having two upward facing slots 406 is positioned and may be braced as necessary. Next the structural members 400*b* and 400*c*, each having one downward facing slot to engage the structural member 400*a* are positioned above, and then lowered to engage the downward facing slots with the upward facing slots in the structural member 400*a*, providing a stable structure to add. Next, a structural member 400*d* having two downward facing slots, having the same lateral spacing as the upward facing slots of the structural member 400*a*, and two upward facing slots outside the upward facing slots (e.g., see FIG. 73), is raised above and lowered to engage the structural members 400*b* and 400*c*.

The second room is added by sequentially adding structural members 400*e* and 400*f*, followed by the last structural member 400*g*. In each instance, the structural members are added by engaging a downward facing slot in the added panel with an upward facing slot in the previously added panel(s).

Either during or after completing the assembly of the structural members, interior panels may be added. The interior panels may be a single panel 414, or a pair of overlapping panels 414*a* and 414*b*, based on the width of the wall the interior panels are forming, and the builder's preference. The inner panels include door 432 and window 430 openings aligned with the openings in the structural members.

Figure 80:
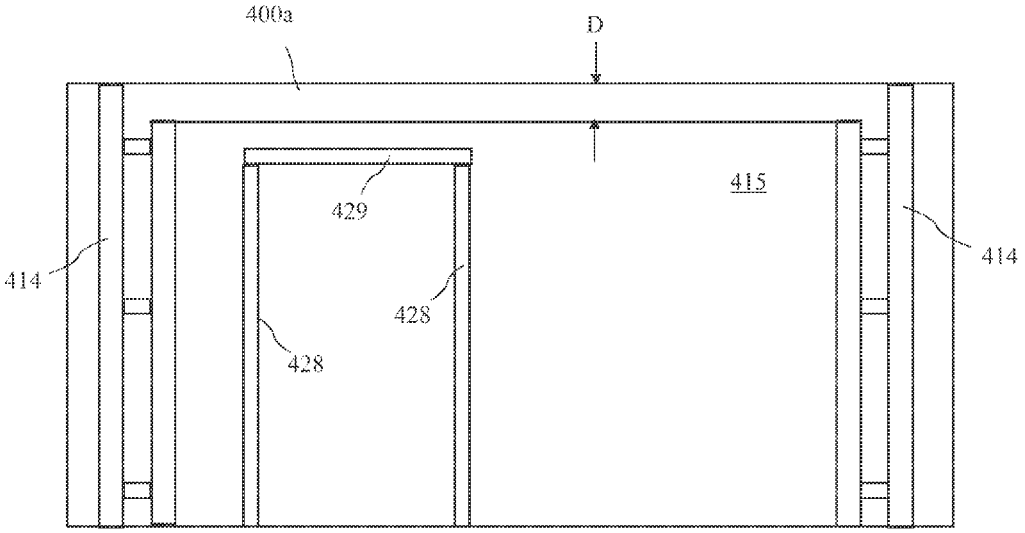
FIG. 80 shows a cross-sectional view of one room of the structure constructed using the second structural members and inner panels according to the present invention taken along line 80-80 of FIG. 79.

FIG. 80 shows a cross-sectional view of one room of the structure constructed using the structural members 400 and inner panels 414 taken along line 80-80 of FIG. 79. Door and window casings 428 and 429 are attached to the structural members and inner panels on both sides and top respectively of the door openings and on all four sides of the window openings. The casings 428 preferably include extensions 428*a* reaching in the space 422 between the structural members and interior panels to position the casings 428, and to allow fasteners 424 to easily attach the casings 428 to the structural members and/or inner panels. Tops of the inner panels are a distance D below tops of the structural members.

Figure 81A:
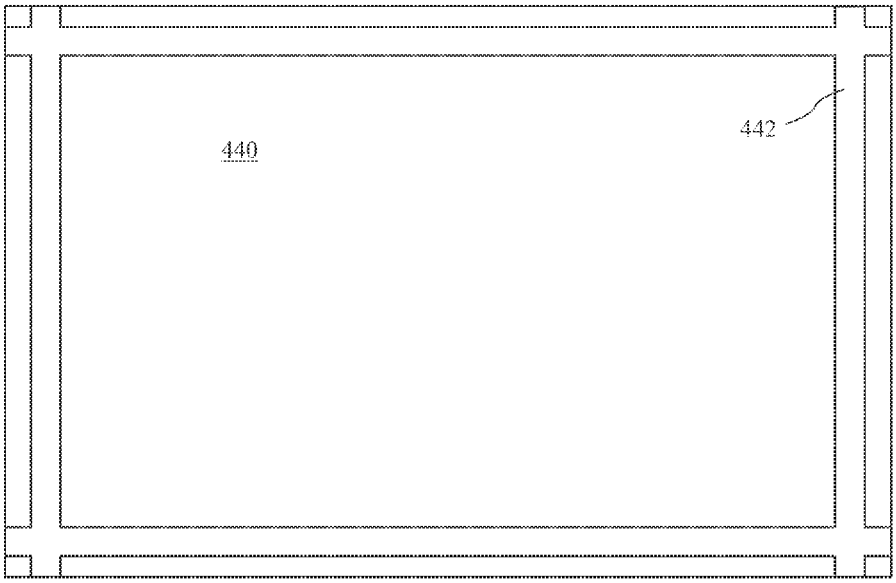
FIG. 81A shows a bottom view of a grooved roof panel for use with the structure constructed using the second structural members and inner panels according to the present invention.
Figure 81B:
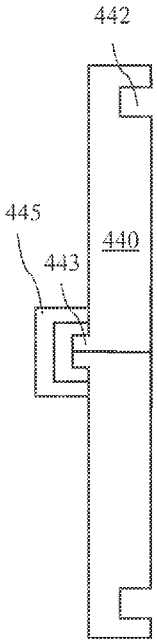
FIG. 81B shows a side edge view of the grooved roof panel for use with the structure constructed using the second structural members and inner panels according to the present invention.
Figure 81C:
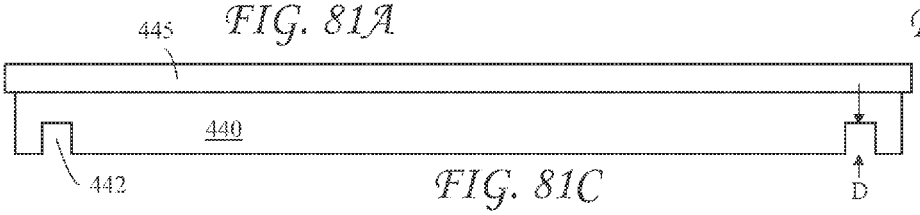
FIG. 81C shows a front edge view of the grooved roof panel for use with the structure constructed using the second structural members and inner panels according to the present invention.

FIG. 81A shows a bottom view of a grooved roof panel 440 for use with the structure constructed using the second structural members and inner panels, FIG. 81B shows a side edge view of the grooved roof panel, and FIG. 81C shows a front edge view of the grooved roof panel. The roof panel 440 includes grooves 442 aligned with the structural members. The grooves are the distance D deep, and allow the roof panel 440 to rest on the structural members with the structural members reaching fully into the grooves 442, and the inner panels butting against the roof panel 440. The roof panel 440 may be a single panel covering one or more room constructed using the structural members, or two or more panels may be combined to cover one or more room.

The roof panels 440 may be single pieces or abutted roof panels. Bracing for any abutted roof panels can be accomplished by securing a flat rectangular overlapping piece 445 straddling the abutted area. The overlapping piece 445 can also waterproof the abutted pieces with an applied rubber sealant. The rubber sealant would not be needed if the overlapping piece 445 has a "U" channel in the center of it and this "U" channel straddles the abutted roof pieces which have been modified to have a raised edge 443. Any water entering under the overlapping piece 445 would run off the edge of the roof due to the raised edges of the abutted roof pieces. The overlapping piece 445 can be secured to the roof pieces with bolts secured to threaded metal inserts located in the roof pieces.

FIG. 82 shows a top view of a two room structure constructed using the second structural members and inner panels, and including an octagonal room. The smaller rectangular room is constructed as described in FIG. 79. The large octagonal room is constructed in the order of structural members 400*h*, 400*i*, 400*j*, 400*k*, 400*l*, 400*m*, 400*n*, and finally 400*o*, although either left side (400*i*, 400*k*, and 400*m*), or the right side (400*j*, 400*l*, and 400*n*) may be independently assembled in order, with the structural member 400*o* add last. The inner panels are similarly assembled as described in FIG. 79. The slots in the structural members are angled as necessary, for example, the slot 406' in the panel 400*h* is shown at an angle A1 of angled 45 degrees as show in FIG. 82*a*. Generally, the angle A1 will be between 0 and 45 degrees for most practical instances, however, angles A1 greater than 45 degrees may be used for special cases. Those skilled in the art will recognize that any number of wall panels, or elements in general, may be interconnected at various angles producing patterns that cross or meander and the general concept of the present invention of a last panel connecting with two earlier connected panels facilitates such construction. Thus, the interconnecting panels and methods of interconnecting the panels allows a builder to produce many interesting designs including six pointed and eight pointed stars.

Figure 83A:
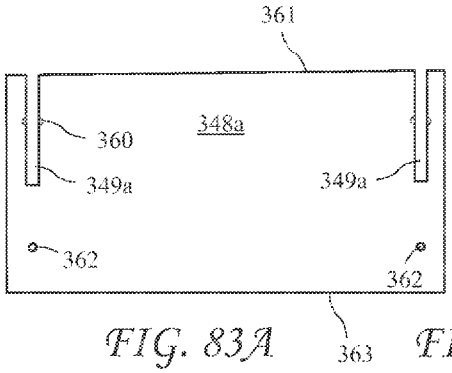
FIG. 83A shows a front view of a first structural member having securing features according to the present invention.
Figure 83B:
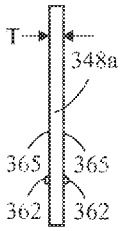
FIG. 83B shows an edge view of the first structural member having securing features according to the present invention.
Figure 84:
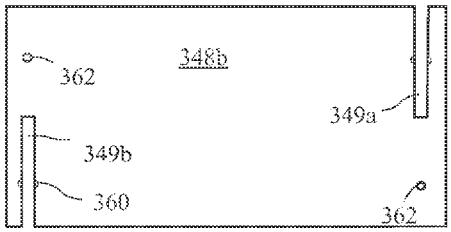
FIG. 84 shows a front view of a second structural member having securing features according to the present invention.
Figure 85:
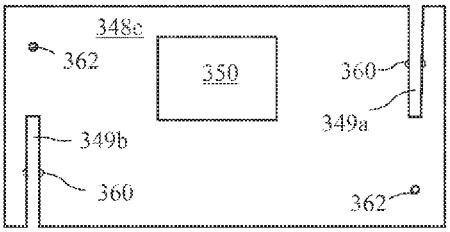
FIG. 85 shows a front view of a third structural member having securing features according to the present invention.
Figure 86:
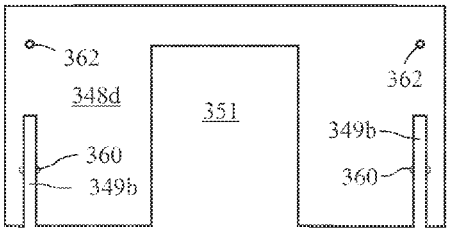
FIG. 86 shows a front view of a fourth structural member having securing features according to the present invention.
Figure 87:
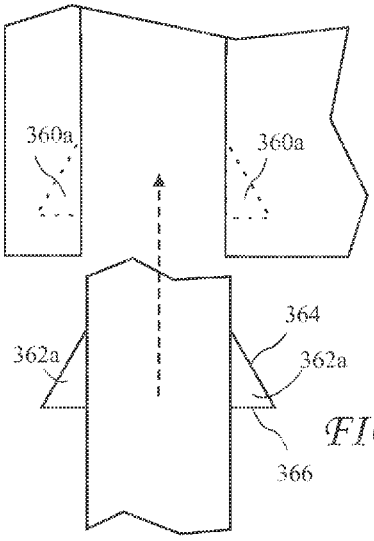
FIG. 87 shows a second embodiment of the securing features according to the present invention.

FIG. 83A shows a front view of a first structural member 348*a* having the securing features 360 and 362 (also see FIG. 63), FIG. 83B shows an edge view of the first structural member 348*a* having the securing features 360 and 362, FIG. 84 shows a front view of a second structural member 348*b* having securing features 360 and 362, FIG. 85 shows a front view of a third structural member 348*v* having securing features 360 and 362, and FIG. 86 shows a front view of a fourth structural member 348*d* having securing features 360 in slots 349*a* and securing features 362 on faces 365 separated by a thickness T much smaller than the faces 365. The structural members 348*a*, 348*b*, 348*c*, and 348*d* include the securing features 360 and 362 and may be assembled to create the structure 352 in the same manner as shown in FIG. 72 to construct a rectangular structure including securing features. The securing features 360 and 362 permit the structure 352 to be lifted and/or moved without the panels disconnecting. The panels include panel tops 361 and panel bases 363. The slots 349*a* reach up to the panel tops 361 and the slots 349*b* reach down to the panel bottoms 363.

While FIGS. 83A-87 show recesses in slots and protrusions on panel faces, those skilled in that art will recognize that the recesses may be on the panel surfaces and the protrusions may be in the slots, and the cooperation of panels having recesses on the panel surfaces and the protrusions in the slots is intended to come within the scope of the present invention.

The securing features 360 and 362 are not limited to perpendicular panels, and panels such as 400*a*-400*o* of FIG. 82 may similarly include the securing features 360 and 362.

The securing features 360 and 362 may further include other shapes. For example, the protruding feature 362 may include a ramp 364 and squared off rear edge 366 shown on FIG. 87. Such ramp 364 and squared off rear edge 366 provide a more secure connection than a rounded protrusion, but are also m ore difficult to release.

FIG. 88A shows a front view of a panel 348*a* having roof and floor attaching protrusion feature 359 and panel attaching protrusion feature 362*a* and FIG. 88B shows an edge view of a panel 348*a* having roof and floor attaching protrusion feature 359 and panel attaching protrusion feature 362*a*.

FIG. 89A shows a front view of a panel 348*a* having roof and floor attaching protrusion feature 359 and panel attaching protrusion feature 362*b* and FIG. 89B shows an edge view of a panel 348*a* having roof and floor attaching protrusion feature 359 and panel attaching protrusion feature 362*b*.

FIG. 90A shows a front view of a panel 348*a* having roof and floor attaching protrusion feature 359 and panel attaching protrusion feature 362*c* and FIG. 90B shows a front view of a panel 348*a* having roof and floor attaching protrusion feature 359 and panel attaching protrusion feature 362*c*.

FIG. 91A shows a front view of a panel 348*a* having roof and floor attaching protrusion feature 359 and panel attaching protrusion feature 362*d* and FIG. 91B shows a front view of a panel 348*a* having roof and floor attaching protrusion feature 359 and panel attaching protrusion feature 362*d*. The floor attaching protrusion feature 359 may be simple rounded bumps, and the top and/or bottom edges of the panels may include slots 339*b* (see FIG. 63D). The protruding features may also extend part of or all of the length of the panel.

FIG. 92A shows a front view of the panel attaching protrusion feature 362*a* comprising a simple rounded bump and FIG. 92B shows a side view of the panel attaching protrusion feature 362*a* comprising a simple rounded bump.

FIG. 93A shows a front view of the panel attaching protrusion feature 362*b*, FIG. 93B shows a side view of the panel attaching protrusion feature 362*b*, and FIG. 93C shows a top view of the panel attaching protrusion feature 362*b*. The panel attaching protrusion feature 362*b* comprising partial cylinder with tapered ends 362' facilitating engagement and disengagement. The tapers 362' may have the same angle or different angles. The protruding feature 362*b* may also be rotated 90 degrees and used as a protruding feature for securing the walls to the floor or ceiling but with squared off ends not tapered ends.

FIG. 94A shows a front view of the panel attaching protrusion feature 362*c* comprising a cruciform shape with tapered ends allowing disengagement and FIG. 94B shows a side view of the panel attaching protrusion feature 362*c* comprising a cruciform.

FIG. 95A shows a front view of the panel attaching protrusion feature 362*d* comprising a square with tapered ends allowing disengagement and FIG. 95B shows a side view of the panel attaching protrusion feature 362*d* comprising a square with two opposing edges tapered.

Only a few examples of different shaped protrusions which may be used with injection molded pieces to obtain retainability are described above. Those skilled in the art will recognize that a large number of protrusions could be used, for example, all letters of the alphabet, any number, geometrical designs, etc. The strength of the individual doing the assembly and disassembly has to be considered in selecting a specific protrusion size and shape. Any shaped protrusion with perpendicular sides will offer some rigidity and retain ability and the width and the height can be selected as needed to retain the structural members. One preferred protrusion includes an adjustable ramp or roundness on both sides of the protrusions so that the force needed for engagement or disengagement can be adjusted for any application. A protrusion having a perpendicular engaging surface could also be used when a permanent structure is desired. Two or more protrusions can be accurately placed on the surfaces of wall panels in a perpendicular row as shown in FIG. 88A assuring that the walls are perpendicular when all protrusions are fully engaged.

Figure 96:
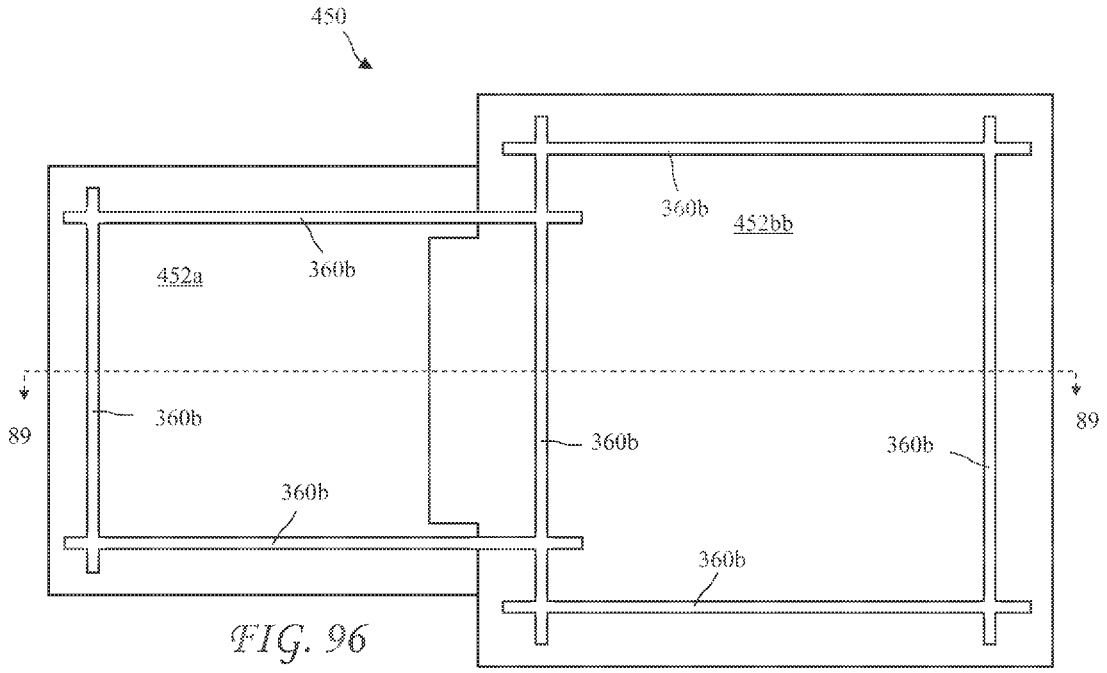
Figure 97:
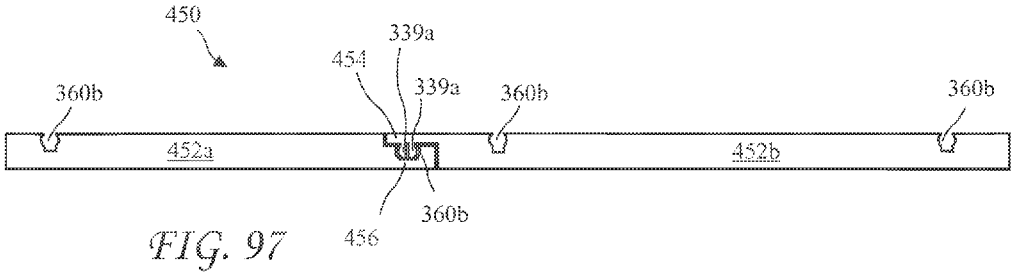

FIG. 96 shows a top view of a two section floor 450 according to the present invention and FIG. 97 show a cross-sectional view of the two section floor 450 taken along line 97-97 of FIG. 95. The floor 450 is constructed from two sections 452*a* and 452*b* include grooves 360*b* which include recesses 360*a* (see FIG. 63D) for receiving based on panels, for example, panels 400*a*-400*g* in FIG. 79. The bases of the panels preferably include protrusions to cooperate with recesses in sides of the grooves 360*b*. The sections include overlapping portions 454 and 456. The portion 454 includes legs 339*a* and the portion 456 includes a groove 360*b*. The legs and groove may include protrusions 362 and cooperating recesses 360*a* to retain the connection of the panels 452*a* and 452*b*. The panels 452*a* and 452*b* may further be constructed of sub-panels (or planks) including similar overlaps to retain the connection of the planks.

Figure 98A:
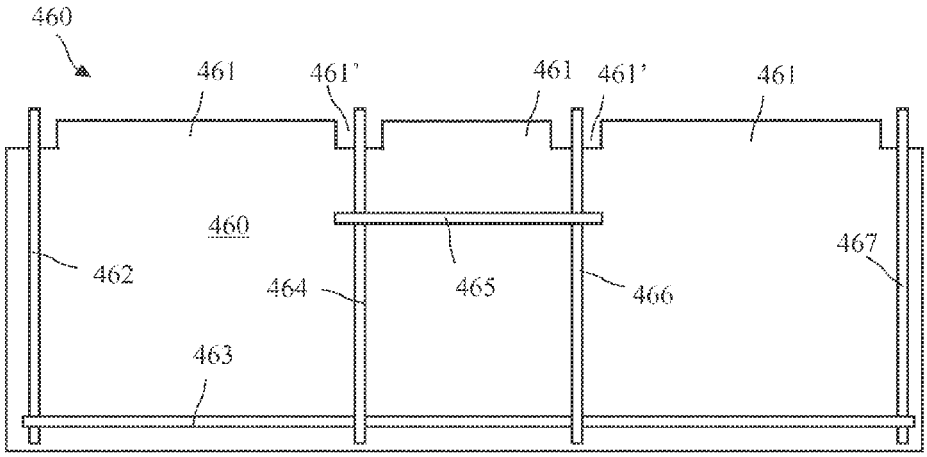
Figure 98B:
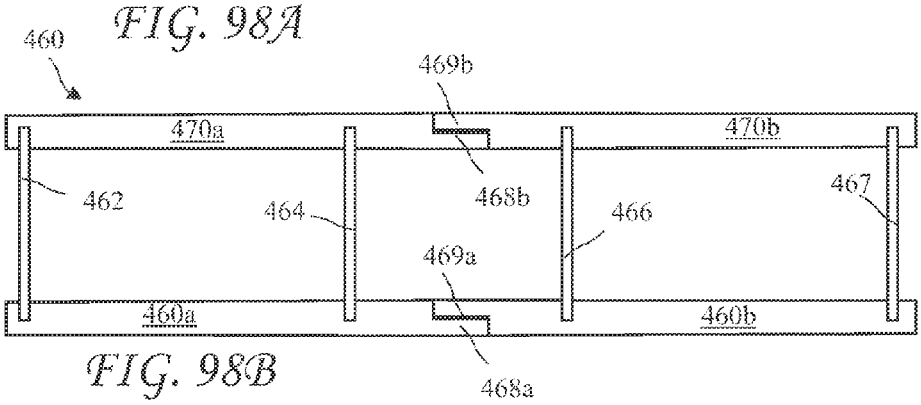

The floor 460*a* and 460B and roof 460*a* and 470*b* of a structure (for example a mobile house) can be assembled using floor sections with overlapping portions 468*a*, 468*b*, 469*a* and 469*b* as shown in FIGS. 98A and 98B. The overlapping portions 468*a*, 468*b*, 469*a* and 469*b* can be secured to each other with bolts inserted through clearance holes in the top overlapping portions 469*a* and 469*b* engaging threaded inserts located in the lower overlapping portions 486*a* and 469*a*. The floor sections can be lifted from a trailer where they have been placed in sequential order with a crane which attaches to eye bolts which are secured to threaded inserts located at the center of gravity in the floor sections. The floor pieces can be checked before the crane releases it to make sure that it is level. The wall sections 462, 463, 464, 465, 466, and 467 are lifted with the crane also in sequential order by attaching a harness to holes in the top of the walls located at the center of gravity and the walls are lowered into the grooves of the floor. Temporary bracing posts may be needed for some walls.

The adjoining wall pieces are secured to each other and to the floor 460*a* and 460*b* with three way "L" brackets which are attached with bolts inserted through clearance holes in the brackets and secured to threaded inserts located in protrusions located on the wall sections 462, 463, 464, 465, 466, and 467 and the floor 460*a* and 460*b*. The clearance holes are large enough to overcome any tolerances in the dimensions of the wall sections 462, 463, 464, 465, 466, and 467 and allows adjustment of the wall to be perpendicular before the bolts are secured. The lock washer and large flat washer underneath the bolt heads will make a secure rigid connection. The large flat washer will possibly slip and slide during an earthquake and the round plastic or metal protrusions will flex in any direction and will withstand a great deal of movement before breaking. The external metal or plastic bracing posts mentioned above will also flex a great deal before breaking.

The roof sections 470*a* and 470*b* are also lifted by a crane in the same manner as the floor sections 460*a* and 460*b* and placed on top of the completed wall structure which already has three way "L" brackets attached in all upper corners of each room. Bolts are inserted to secure the three way "L" brackets to the roof in the same manner as the floor was secured. Bolts are also used to secure overlapping flanges of roof sections. The floor 460*a* and 460*b* and roof 470*a* and 470*b* are generally mirror images of each other. An example of the above mentioned protrusions with threaded inserts is shown in FIG. 77C. All of the above securing methods and assembly methods is well understood by anyone skilled in the art. The above discussion on the assembly of a house also applies to the assembly of a storage shed which could also serve as a tornado shelter. The tornado shelter structural members and the door could be a thick steel as well as the external bracing posts. The tornado shelter will not have any windows that can break, but houses could have acrylic windows that are about 80 times stronger than glass. This structure could equal or surpass the protection obtained from an underground steel room which is subject to flooding. There has been loss of life due to this problem of flooding. I will have houses and shelters tested for their structural strength by performing shake table, wind tunnel, and field tests.

FIG. 98A shows a top view of a floor 460 and wall sections 462, 463, 464, 465, 466, and 467 and FIG. 98B shows a front view of the two piece floor 460*a* and 460*b*, wall sections 462, 464, 466, and 467, and roof sections 470*a* and 470*b*. The overlapping portion 461 of the floor piece 460 may include breaks 461' to retain rigidity where floor groves are present.

Figure 99A:
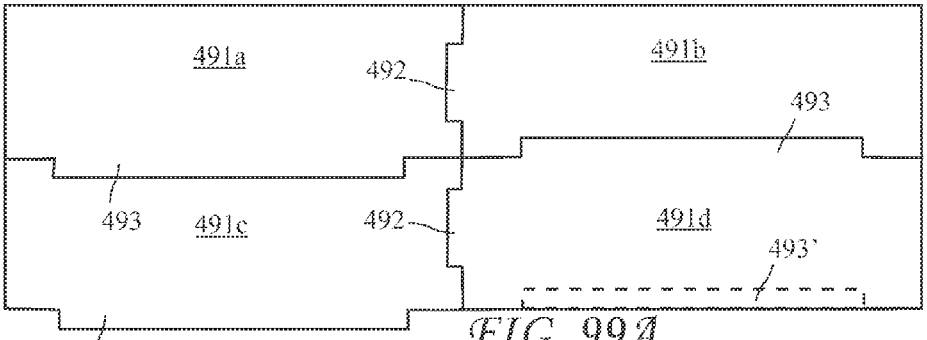
Figure 99B:
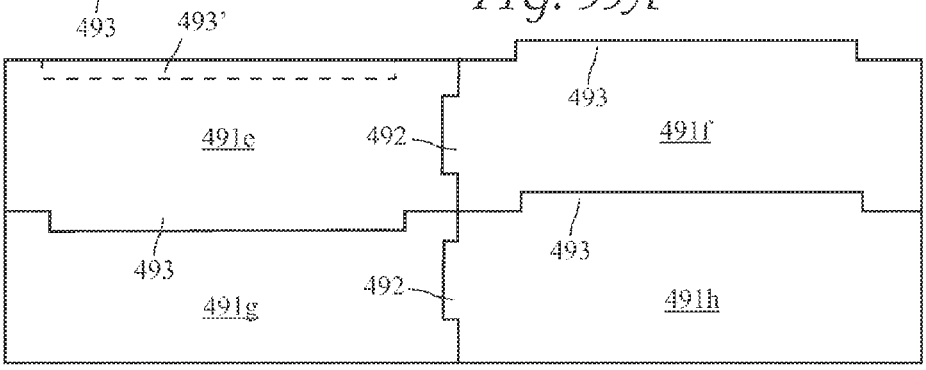

FIG. 99A shows a top view of a four floor piece at the rear of a structure and FIG. 99B shows a top view of four floor piece at a rear of a structure. The floor sections include overlapping portions 492 and 493 and show underlapping portions 493' as dashed lines. Intermediate floor pieces include cooperating underlapping and overlapping portions.

Figure 100:
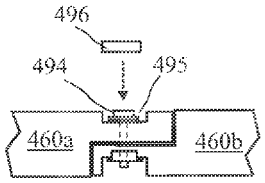

FIG. 100 shows a bolt 494 used to attach floor sections. Recesses 495 are provided in the overlapping portions to provide space for the fastener 494. A threaded plug 496 may be used to fill the recess 495 after tightening the bolt 494.

FIG. 101A a single room partition, FIG. 101B shows a second room partition for dividing as room into four rooms, and FIG. 101C shows a cooperating second room partition for dividing as room into four rooms according to the present invention. The downward open center slot 349*b* of the partition 347*b* engages the center upward open slot 349*a* of the partition 347*a*.

FIG. 102A shows a perimeter structure 496 dividing a room into four rooms according to the present invention and FIG. 102B shows a floor or roof 497 for the structure of FIG. 102A. The partitions 347*a* and 347*b* engage the perimeter 496 and each other to form a ridged structure. The walls of the perimeter 496 provide support in two horizontal directions due to the 45 degree cut at each end.

FIG. 103A shows a second perimeter structure 496' dividing a room into four rooms and FIG. 103B shows a floor or roof 497' for the structure of FIG. 103A. The partitions 347*a* and 347*b* engage each other to form a ridged structure with perimeter 496'. Each section of the perimeter 496' provides support in one horizontal direction. Mating surfaces may have rounded or ramped edges to widen the contact area for ease of assembly.

FIG. 104 shows a triangular structure 460 or puzzle according to the present invention and FIG. 105 shows a six sided structure 490 or puzzle according to the present invention. The three elements of the structure 460 are a first member 462, and second member 464, and a third member 466. The members 462, 464, and 466 are assembled in the order shown by Roman numerals I, II, and III by engaging upward and downward slots of each member. The member 420 includes two upward opening slots, the member 464 includes one downward opening slot for engaging the member 462, and an upward opening slot. The member 466 includes two downward opening slots for engaging the members 462 and 464.

The structure 490 is constructed by adding three additional members. Member 492 having two downward opening slots for engaging the members 462 and 464 and two upward opening slots. The member 494 has three downward opening slots for engaging the members 464, 466, and 492, and one upward opening slot. The member 496 having four downward opening slots for engaging the members 462, 466, 492, and 494. The members 492, 494, and 496 are assembled in the order shown by Roman numerals IV, V, and VI by engaging upward and downward slots of each member.

The arrangement of slots in the members 462, 464, 466, 492, 494, and 496 correspond to the order of assembly. Various designation may be placed on the members in an order corresponds to the order of assembly to provide both a game, and a learning tool. For example, the designations may correspond to the order of letters in the alphabet when a larger number of members are used in more complex structures.

Puzzles can be of any number of pieces and the most basic suitable for the youngest age group is the triangle or three pieces. Pictures can be placed on each piece of the triangle and on the box or package to aid the child to assemble the triangle. One example is that piece number one, with two up slots, has a picture of two birds of different types setting on a tree limb. Piece number two, with an up and down slot, have a picture of the bird flying toward the limb which is the one closest to the connection point of the two pieces. The second bird would be pictured in the same manner on piece number three, with two down slots. Another example would be two different cars on piece one and one of the cars on piece two and the other car on piece three, etc. The triangle pieces can also be marked with the numbers 1, 2 and 3 or A, B, and C.

Puzzles can also be assembled by connecting two or more identical or different patterns to each other. Referring to FIG. 105, an example easy to understand is to assemble two identical triangles and the two triangles have cooperating slots located on the top of one of the triangles and on the bottom of the other triangle so that this triangle can be placed on top of the other triangle and interlocked to produce a Star of David design. This Star of David design can also be assembled in sequential order using six structural members connected to each other one piece at a time. The Star of David design has seven modules or rooms needing a floor and a roof to produce an interesting puzzle house. Stars with six or eight points can be assembled using the zigzag method of design producing a single module or room.

Puzzles designed for the youngest age group require a minimum of rigidity and no retain ability. The puzzle pieces connect and disconnect easily and are made from an FDA approved plastic. Injection molded parts can be held to very close tolerances for the dimensions of the slots and the thickness of the pieces allowing easy assembly and disassembly of the pieces which is the same for most puzzles. Increased rigidity is obtained by closely matching the width of the slot to the thickness of the pieces. This will hold the shape of the structure only if the thickness of the pieces is above a certain minimum which varies with different materials.

FIG. 106 shows a method for assembling structural members 400 according to the present invention. The particular arrangement of the slots 406 allow a single individual, or even a child, to construct the structure because connecting the structure members provides a stable construction which the structure members are subsequently added to. The structure members and methods of the present invention may be applied to various full size and miniature structures.

The method includes:

positioning a first structural member at step 500, which includes positioning the first structural member having vertically side by side first and second parallel slots with the first and second parallel slots facing upward;

lifting a second structural above the first structural member at step 502, which includes lifting a second structural member having vertically offset third and fourth parallel slots above the first structural member with the third slot facing downward;

lowering the second structural member and engaging the second structural member providing a stable structure at step 504, which includes lowering the second structural member and engaging the third slot of the second structural member with the second slot of the first structural member providing a stable structure;

lifting a third structural member above the first structural member at step 506, which includes lifting a third structural member having vertically offset fifth and sixth parallel slots above the first structural member with the fifth slot facing downward;

lowering the third structural member and engaging the first structural member providing a more stable structure at step 508, which includes lowering the third structural member and engaging the fifth slot of the third structural member with the second slot of the first structural member providing a more stable structure;

lifting a fourth structural member above the second and third structural members at step 510, which includes lifting a fourth structural member having vertically side by side seventh and eighth parallel slots above the second and third structural members with the seventh and eighth slots facing downward; and lowering the fourth structural member and engaging the fourth structural member with the second and third structural members providing a completed stable structure at step 512, which includes lowering the fourth structural member and at the same time, comprising:

engaging the seventh slot of the fourth structural member with the fourth slot of the second structural member; and engaging the eighth slot of the fourth structural member with the sixth slot of the third structural member providing a completed stable structure.

A second room may be added to the stable structure following the steps:

lifting next structural members above the engaged structural member at step 514;

lowering the next structural members and engaging the next structural members with the engaged structural member at step 516;

lifting a last structural member above the engaged structural members at step 518; and lowering the last structural member and engaging the engaged structural members to complete the structure at step 520.

FIG. 106 described one set of steps for assembly of a structure. The present invention recognizes the general concept of positioning a first panel with two upward facing slots, and attaching additional panels with one upward and one downward facing slot, and a final panel with two downward facing slots. Such methods establish a stable structure from the attachment of the first and second panels, and allow construction of more complex structures by adding panels to the initial stable structure.

Additionally, the structures may be assembled on a notched base 330, 332, and 331 (see FIG. 61) and the structure m embers 348*a*-348*e* and 354*a* and 354*b* may further include recesses 360 and protrusions 362 shown in FIG. 63.

FIG. 107 shows a method for attaching a roof panel to an assembled structure according to the present invention. The method includes positioning roof panels over the structural members at step 600, aligning grooves on a bottom surface of the roof panel with top edges of the structural members at step 602, engaging the grooves in the roof panel with the top edges of the structural members at step 604, and attaching any remaining roof panels to the structural members at step 606.

FIG. 108 shows a method for adding interior panels, doors, and windows to a structure. The method includes attaching interior panels to interior sides of the structural members at step 700, attaching door casings to sides and top of door openings in the interior panels and the structural members at step 702, attaching doors to the door casing at step 704, attaching window casings to sides, top and bottom of window openings in the interior panels and the structural member at step 706, and attaching windows to the window casing at step 708. Preferably, attaching door and window casings includes inserting extensions reaching in the space 422 between the structural members and interior panels to position the casings and driving fasteners through the structural members and/or the interior panels and into the extensions.

While certain embodiments are described here, the construction according to the present invention can be used to make, for example, a loveseat or settee just by changing the physical dimensions of the parts of the chair structures described herein. Using the same process one can design a bed. These and other embodiments will be apparent to those skilled in the art and are intended to come within the scope of the present invention.

Structural members used to construct larger structures may be lightened in various ways, in addition to using open structural members. For example, walls may be formed as a thin honey comb metal shell in the shape of the structural members. After the lightweight shells have been assembled into the final structure, they can be filled with cement through fill holes in the top side of the wall pieces. If a permanent house is desired and can be filled with water, oil or sand if a mobile home is desired. Fill and drain holes located in the top and bottom sides of the wall pieces can have a sealer screw in plug.

It can be seen from the above explanation of present invention that an unskilled person can design a house with a perimeter of any shape and the number and shape of rooms desired. The manufacturing facility would refine the unskilled person's floor plan adding a floor and roof like FIGS. 18, 19, 23, 27, 53, 58, 61, 81*a*, and the drawing of 80 each prefabricated floor and roof pieces and locations of plumbing, electrical wiring, air conditioning, etc. The house could be assembled and disassembled very fast with the use of a crane because each piece will have a number or a letter and a number indicating the sequential order of assembly. Floor pieces would be marked F1, F2, and F3 etc. Wall pieces would be marked 1, 2, and 3 etc. Internal wall pieces would be marked A1, A2, and A3, etc. for room "A" and B1, B2, and B3, etc. for room "B". Roof pieces would be marked R1, R2, and R3, etc. The manufacturing facility would already have standard floor, roof and wall pieces approved by Federal Government Regulations. They would only need to adjust the size of the pieces to fill the customer's order. The manufacturing facility can offer all services for the assembly of the house or allow the customer to complete any or all of the tasks involved to save money.

While the invention herein disclosed has been described by means of specific embodiments and applications thereof, numerous modifications and variations could be made thereto by those skilled in the art without departing from the scope of the invention set forth in the claims.

I claim:

1. A method for sequentially interconnecting structural members in rigid alignment to construct a stable structure, the method comprising:

positioning a first structural member having vertically side by side first and second parallel slots and a multiplicity of vertically and horizontally spaced apart first spacers on an inside surface, with the first and second parallel slots facing upward and the first spacers extending towards an interior of the stable structure;

lifting a second structural member having vertically offset third and fourth parallel slots and a multiplicity of second spacers above the first structural member, with the third slot facing downward and the second spacers extending towards the interior of the stable structure;

lowering the second structural member and engaging the third slot of the second structural member with the first slot of the first structural member providing a first stable structure;

lifting an additional structural member having vertically offset downward and upward facing parallel slots, and a multiplicity of additional spacers, above one of the engaged structural members having an open upward facing slot, with the downward facing slot of the additional structural member aligned with the open upward facing slot of the engaged structural member, and the additional spacers extending towards the interior of the stable structure;

lowering the additional structural member and engaging the downward facing slot of the additional structural member with the open upward facing slot of the engaged structural member, providing a third stable structure;

engaging additional structural members with the engaged structural members until only a single final structure member remains unengaged;

completing a first room of the stable structure by lifting the final structural member having vertically side by side downward facing parallel slots, above two of the engaged structural members having open upward facing slots;

lowering the final structural member, and engaging each of the downward facing slots of the final structural member with the open upward facing slots of the engaged structural members; and attaching inner panels to the first, second, and additional spacers to provide an interior wall for the stable structure to compete the stable structure, wherein at least two of the structural members include upward opening slots;

positioning a partition above the stable structure, wherein two downward opening slots of the partition are aligned with the two upward opening slots; and lowering the partition to engage the two downward opening slots with the two upward opening slots to divide the stable structure into a two room structure.

2. The method of claim 1, further providing a space between the inner panels and the corresponding one of the structural members for insulation, electrical or plumbing requirements.

3. The method of claim 1, further including:

positioning a roof panel over the structural members;

aligning slots on a bottom surface of the roof panel with top edges of the structural members; and engaging the slots in the roof panel with the top edges of the structural members.

4. The method of claim 1, wherein at least one of the structural members and a corresponding one of the inner panels includes a door opening, and further including:

attaching door casings to sides and top of door opening in the inner panel and the structural member; and attaching doors to the door casings.

5. The method of claim 1, wherein at least one of the structural members and a corresponding one of the inner panels includes a window opening, and further including:

attaching window casings to sides, top and bottom of window opening in the interior panel and the structural member; and attaching windows to the window casings.

6. The method of claim 1, further including a floor constructed from floor sections, the floor including grooves corresponding to the structural members, wherein positioning the structural members includes inserting the structural members into the grooves in the floor.

7. The method of claim 6, wherein the grooves include recesses and the structural members include protrusions to engage the recesses to retain the structural members.

* * * * *